US011694502B2

(12) United States Patent
Kamano

(10) Patent No.: US 11,694,502 B2
(45) **Date of Patent: *Jul. 4, 2023**

(54) GAMING MACHINE, CONTROL METHOD FOR MACHINE, AND PROGRAM FOR GAMING MACHINE

(71) Applicant: Konami Gaming, Inc., Las Vegas, NV (US)

(72) Inventor: Kenichi Kamano, Zama (JP)

(73) Assignee: KONAMI GAMING, INC.—SLOTS, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/185,696

(22) Filed: Feb. 25, 2021

(65) Prior Publication Data

US 2021/0390820 A1 Dec. 16, 2021

Related U.S. Application Data

(63) Continuation of application No. 15/953,171, filed on Apr. 13, 2018, now Pat. No. 10,977,891.

(51) Int. Cl.
*G07F 17/32* (2006.01)
*G07F 17/34* (2006.01)

(52) U.S. Cl.
CPC ..... *G07F 17/3213* (2013.01); *G07F 17/3227* (2013.01); *G07F 17/3244* (2013.01); *G07F 17/3267* (2013.01); *G07F 17/34* (2013.01)

(58) Field of Classification Search
CPC ..... G07F 17/3213; G07F 17/3227; G07F 17/3244; G07F 17/3267; G07F 17/34
See application file for complete search history.

(56) References Cited

U.S. PATENT DOCUMENTS

2005/0215311 A1* 9/2005 Hornik ..... G07F 17/3267 463/20
2006/0040730 A1 2/2006 Walker et al.
2006/0183531 A1 8/2006 Thomas
2006/0246979 A1* 11/2006 Chim ..... G07F 17/3244 463/13
2012/0309503 A1* 12/2012 Scott ..... G07F 17/3244 463/25
2018/0311581 A1 11/2018 Patta

FOREIGN PATENT DOCUMENTS

JP 2015-196081 A 11/2015
JP 2017-202247 A 11/2017

* cited by examiner

*Primary Examiner* — Yingchuan Zhang
(74) *Attorney, Agent, or Firm* — Howard & Howard Attorneys PLLC

(57) ABSTRACT

A gaming machine is described herein. The gaming machine includes a control unit programmed to display a primary game screen including a plurality of virtual reels, receive a signal indicating a wager being placed on the primary game, and initiate a bonus feature selection game by displaying a bonus feature selection game screen including a plurality of bonus features. The processor receives a signal indicating one or more wagers being placed on the bonus feature game by the player, and responsive to each wager, randomly selects a bonus feature from the plurality of bonus features and modifies a bonus feature image to indicate a number of times the corresponding bonus feature has been randomly selected. The processor receives a signal to terminate the bonus feature game and initiates an instance of the primary game using the selected bonus features.

17 Claims, 30 Drawing Sheets

132

260

262

264

| | R1 | R2 | R3 | R4 | R5 |
|---|---|---|---|---|---|
| 1 | PicB | Wild | PicB | PicD | Trigger |
| 2 | Q | Wild | Trigger | 9 | PicA |
| 3 | K | Wild | J | 10 | 10 |
| 4 | PicA | Q | Q | Trigger | A |
| 5 | 9 | 9 | PicD | PicD | PicA |
| 6 | J | J | Wild | Q | K |
| 7 | K | Trigger | J | A | 10 |
| 8 | PicA | PicB | Q | Wild | 9 |
| 9 | 9 | 10 | PicA | Wild | Wild |
| 10 | Trigger | PicA | A | Wild | Wild |
| 11 | J | Wild | K | PicB | Wild |
| 12 | PicC | Wild | PicA | inn | PicC |
| 13 | Wild | Wild | A | inn | PicB |
| 14 | Wild | inn | J | inn | 10 |
| 15 | Wild | inn | inn | inn | inn |
| 16 | A | inn | inn | inn | inn |
| 17 | Q | inn | inn | J | inn |
| 18 | PicD | inn | Wild | Q | inn |
| 19 | J | A | Wild | PicC | inn |
| 20 | inn | J | Wild | A | PicA |

FIG. 27

134

| Stop Position | Random Number Range |
|---|---|
| 1 | 1-50 |
| 2 | 51-100 |
| 3 | 101-150 |
| 4 | 151-200 |
| 5 | 201-250 |
| 6 | 251-300 |
| 7 | 301-350 |
| 8 | 351-400 |
| 9 | 401-450 |
| 10 | 451-500 |
| 11 | 501-550 |
| 12 | 551-600 |
| 13 | 601-650 |
| 14 | 651-700 |
| 15 | 701-750 |
| 16 | 751-800 |
| 17 | 801-850 |
| 18 | 851-900 |
| 19 | 901-950 |
| 20 | 951-1000 |

FIG. 28

136

| | 208 Items | 218 Probability | 214 Selling price (credits) | 220 Return to Player |
|---|---|---|---|---|
| 244 | Wild | 12.5% | 250 | 31.25% |
| 246 | Multiplier | 5.6% | 500 | 28.00% |
| 248 | Free Spin | 16.7% | 150 | 25.05% |
| 250 | Lose | 65.2% | 5 | 3.26% |
| | Total | 100.0% | -------- | 87.56% |

FIG. 29

228

| | 208 Items | 218 Probability | 230 Expected return to player (%) | 220 Return to Player |
|---|---|---|---|---|
| 244 | Wild | 12.5% | 250.0% | 31.25% |
| 246 | Multiplier | 5.6% | 500.0% | 28.00% |
| 248 | Free Spin | 16.7% | 150.0% | 25.05% |
| 250 | Lose | 65.2% | -------- | 3.26% |
| | Total | 100.0% | -------- | 87.56% |

FIG. 30

138

| Game Symbol | Selection Probability | Random Number Range |
|---|---|---|
| 9 | 20% | 1-200 |
| 10 | 20% | 201-400 |
| J | 10% | 401-500 |
| Q | 10% | 501-600 |
| K | 10% | 601-700 |
| A | 10% | 701-800 |
| PicA | 5% | 801-850 |
| PicB | 5% | 851-900 |
| PicC | 5% | 901-950 |
| PicD | 5% | 951-1000 |

FIG. 31

140

252 214

246

| Items | Probability | Selling price (credits) | Return to Player |
|---|---|---|---|
| Multiplier x 100 | 0.5% | 4600 | 23.00% |
| Multiplier x 50 | 1.0% | 2000 | 20.00% |
| Multiplier x 10 | 11.0% | 400 | 44.00% |
| Multiplier x 1 | 87.5% | 1 | 0.88% |
| Total | 100.0% | -------- | 87.88% |

FIG. 32

140

254 214

246

| Items | Probability | Selling price (credits) | Return to Player |
|---|---|---|---|
| Progressive probability x 7 | 1.0% | 5400 | 54.00% |
| Progressive probability x 5 | 2.0% | 1500 | 30.00% |
| Progressive probability x 3 | 5.0% | 40 | 2.00% |
| Progressive probability x 2 | 92.0% | 2 | 1.84% |
| Total | 100.0% | -------- | 87.84% |

FIG. 33

222

| | Bet (Credits) | Return to Player (%) |
|---|---|---|
| Base Game | 450 | 87.00% |
| Loot box feature | 100 | 87.56% |

226

224

FIG. 34

210

208 216 214

| Loot Box Items | Feature Count | Bonus Feature Credit Value | Total Credit Value |
|---|---|---|---|
| Wild | 1 | 250 | 250 |
| Multiplier | 0 | 500 | 0 |
| Free Spin | 1 | 150 | 150 |
| Lose | 3 | 5 | 15 |

212

FIG. 35

232

| # of loot box challenged | Return to Player / Base game (%) | Total Bet (Credits) | Return to Player / Total (%) |
|---|---|---|---|
| 0 | | 450 | 87.00% |
| 1 | | 550 | 87.10% |
| 2 | | 650 | 87.17% |
| 3 | | 750 | 87.22% |
| : | | : | --------- |
| 5 | 87.00% | 950 | 87.29% |
| 10 | | 1450 | 87.39% |
| 20 | | 2450 | 87.46% |
| 50 | | 5450 | 87.51% |
| 100 | | 10450 | 87.54% |
| : | | : | : |

FIG. 36

GAMING MACHINE, CONTROL METHOD FOR MACHINE, AND PROGRAM FOR GAMING MACHINE

CROSS-REFERENCE TO RELATED APPLICATION

This application is a continuation of U.S. patent application Ser. No. 15/953,171, filed Apr. 13, 2018, the disclosure of which is hereby incorporated by reference in its entirety.

TECHNICAL FIELD

The present invention relates to a gaming machine, a control method for a gaming machine, and a program for a gaming machine.

BACKGROUND ART

A gaming machine represented by a slot machine is highly popular among casino customers as a device that provides gaming that is easy to enjoy, and recent statistics report that sales from gaming machines account for the majority of casino earnings. Initial slot machines were simple devices, wherein an inserted coin is received, a configured reel rotates and stops mechanically according to a handle operation, and a win or a loss is determined by a combination of symbols stopped on a single pay line. However, recent gaming machines, such as mechanical slot machines driven by a highly accurate physical reel via a computer controlled stepping motor, video slot machines that display a virtual reel on a display connected to a computer, and various gaming machines that apply similar technology to other casino games are quickly advancing. For the manufacturers that develop these gaming machines, an important theme is to provide an attractive game that strongly attracts casino customers as players, and improves the functionality of the gaming machine.

SUMMARY OF INVENTION

In one aspect of the present invention, a gaming machine is provided. The gaming machine includes an operation unit, a display unit, a memory device, and a game control unit. The operation unit is configured to receive an operation input of a player. The display unit is configured to display game screens including computer generated graphics. The memory device stores a game execution program that includes computer instructions for generating a game including a primary game including a plurality of virtual reels displaying a plurality of game symbols and a bonus feature selection game including a plurality of bonus features associated with the primary game. The game control unit functions to executing the game. The game control unit includes a processor programmed to display a primary game screen on the display unit including the plurality of virtual reels and a bonus feature game icon, receive a signal from the operation unit indicating a wager being placed on the primary game by the player, and responsively initiate the bonus feature selection game by displaying a bonus feature selection game screen on the display unit including a plurality of bonus feature images associated with each of the plurality of bonus features. The processor receives a signal from the operation unit indicating one or more wagers being placed on the bonus feature game by the player, and responsive to receiving each signal indicating a wager being placed by the player, randomly selects a bonus feature from the plurality of bonus features and modifies a bonus feature image associated with the selected bonus feature to indicate a number of times the corresponding bonus feature has been randomly selected. The processor terminates the bonus feature game in response to receiving a signal from the operation unit indicating a request to terminate the bonus feature game by the player, and initiates an instance of the primary game using the selected bonus features. The processor then provides a primary game award to the player based on an outcome of the instance of the primary game and adjusts a credit balance associated with the player based on the primary game award.

In another aspect of the present invention, one or more non-transitory computer-readable storage media, having computer-executable instructions embodied thereon is provided. When executed by a processor, the computer-executable instructions cause the processor to display a primary game screen including computer-generated graphics displaying a primary game on a display unit. The primary game screen includes a plurality of virtual reels and a bonus feature game icon. The processor receives a signal from an operation unit indicating a wager being placed on the primary game by the player and responsively initiates a bonus feature selection game by displaying a bonus feature selection game screen on the display unit including a plurality of bonus feature images associated with a plurality of bonus features. The processor receives a signal from the operation unit indicating one or more wagers being placed on the bonus feature game by the player and, responsive to receiving each signal indicating a wager being placed by the player, randomly selects a bonus feature from the plurality of bonus features, and modifies a bonus feature image associated with the selected bonus feature to indicate a number of times the corresponding bonus feature has been randomly selected. The processor receives a signal from the operation unit indicating a request to terminate the bonus feature game by the player, terminates the bonus feature game in response to the request, and initiates an instance of the primary game using the selected bonus features. The processor then provides a primary game award to the player based on an outcome of the instance of the primary game and adjusts a credit balance associated with the player based on the primary game award.

In still another aspect of the present invention, a mobile computing device is provided. The mobile computing device includes a touch display unit, a memory device, and a processor. The touch display unit is configured to display game screens including computer generated graphics and receive an operation input of a player. The memory device stores a game execution program including computer instructions for generating a primary game including a plurality of virtual reels displaying a plurality of game symbols and a bonus feature selection game including a plurality of bonus features associated with the primary game. The processor is programmed to display a primary game screen on the touch display unit including the plurality of virtual reels and a bonus feature game icon, receive a signal from the touch display unit indicating a wager being placed on the primary game by the player, and responsively initiate the bonus feature selection game by displaying a bonus feature selection game screen on the display unit including a plurality of bonus feature images associated with each of the plurality of bonus features. The processor receives a signal from the touch display unit indicating one or more wagers being placed on the bonus feature game by the player and, responsive to receiving each signal indicating a wager being placed by the player, randomly selects a bonus feature from the plurality of bonus features and modifies a bonus feature image associated with the selected bonus feature to indicate a number of times the corresponding bonus feature has been randomly selected. The processor receives a signal from the touch display unit indicating a request to terminate the bonus feature game by the player, terminates the bonus feature game in response to the request, and initiates an instance of the primary game using the selected bonus features. The processor then provides a primary game award to the player based on an outcome of the instance of the primary game and adjusts a credit balance associated with the player based on the primary game award.

BRIEF DESCRIPTION OF DRAWINGS

FIGS. 27-36 are exemplary illustrations of computer program data files that may be used by the gaming machine shown in FIGS. 1A-1B and the server system shown in FIGS. 11 and 12, according to embodiments of the present invention.

Corresponding reference characters indicate corresponding parts throughout the drawings.

DETAILED DESCRIPTION OF EMBODIMENTS

A gaming machine, according to an embodiment of the present invention, referencing the attached figures is described in detail below. Further, duplicated descriptions will be omitted for identical attached symbols in identical or corresponding parts in each figure.

With reference to the drawings, and in operation, the present invention is directed towards a gaming machine, a control method for a gaming machine, and a program for a gaming machine and/or mobile computing device that provides a game to a player.

The present invention improves the functionality of existing gaming machines by providing a game execution program including computer instructions executed by a processor to operate a game that includes a primary game and a bonus feature selection game that randomly selected bonus features that are used during the primary game, and allows players to sell and/or exchange the bonus features for credits. The present invention also determines the credit values associate with each bonus feature based on the return the player associated with the use of the bonus features. Thus increasing the flexibility of providing bonus credit awards to players during the bonus feature event, and increasing the player's interest in playing the game.

The bonus feature selection game, also referred to as a Loot Box™ feature game, allows the player to bet the primary base game bet and then allows the payer to buy bonus feature items during loot box feature screen. That is, the loot box feature game is incorporated into the primary base game. The loot box feature is activated by a loot box feature button displayed with the primary base game. The loot box feature screen is appeared after game start. The player can buy and sell items a plurality of times in the loot box feature screen. The primary game reel spin is started after exiting the loot box feature screen. Bonus features may include a wild item feature, a multiplier item feature, and a free game feature. A wild symbol is added on the random reel position, if the player had the wild item bonus feature. The base game win is multiplied, if the player had the multiplier item. The free game is started after base game, if the player had the free spin item. Several variations of bonus features may be included in the Loot Box™ bonus feature selection game. For example, the bonus feature items have several variations, including multiplier x1, Multiplier x2 . . . , 2 kinds of Wild, 3 kind of Wilds . . . , 5 Free Games, 10 Free Games, For Progressive probability upgrade, etc. In addition, any other items can be provided for game entertainment improvement including character of cheering group. The chance to buy a bonus feature item may be occur suddenly, if the player did not select a future. The Loot Box™ game may also be combined with all type of game e.g., Poker, Kino and etc. Variations of game flow for loot box and primary game and additional feature game may also be provided.

Figure 1A:
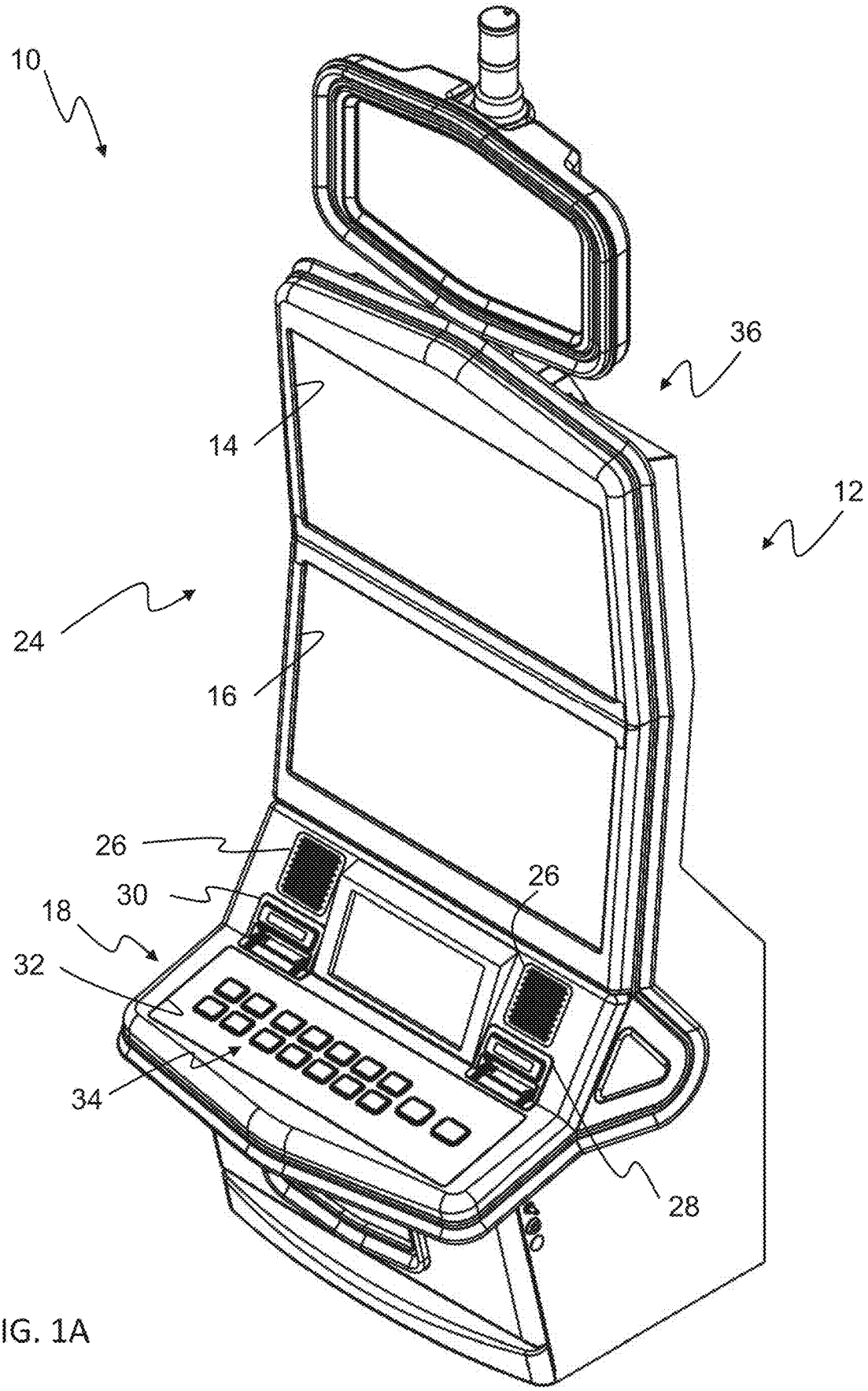
FIG. 1A is a perspective view of the gaming machine, according to the first embodiment.
Figure 1B:
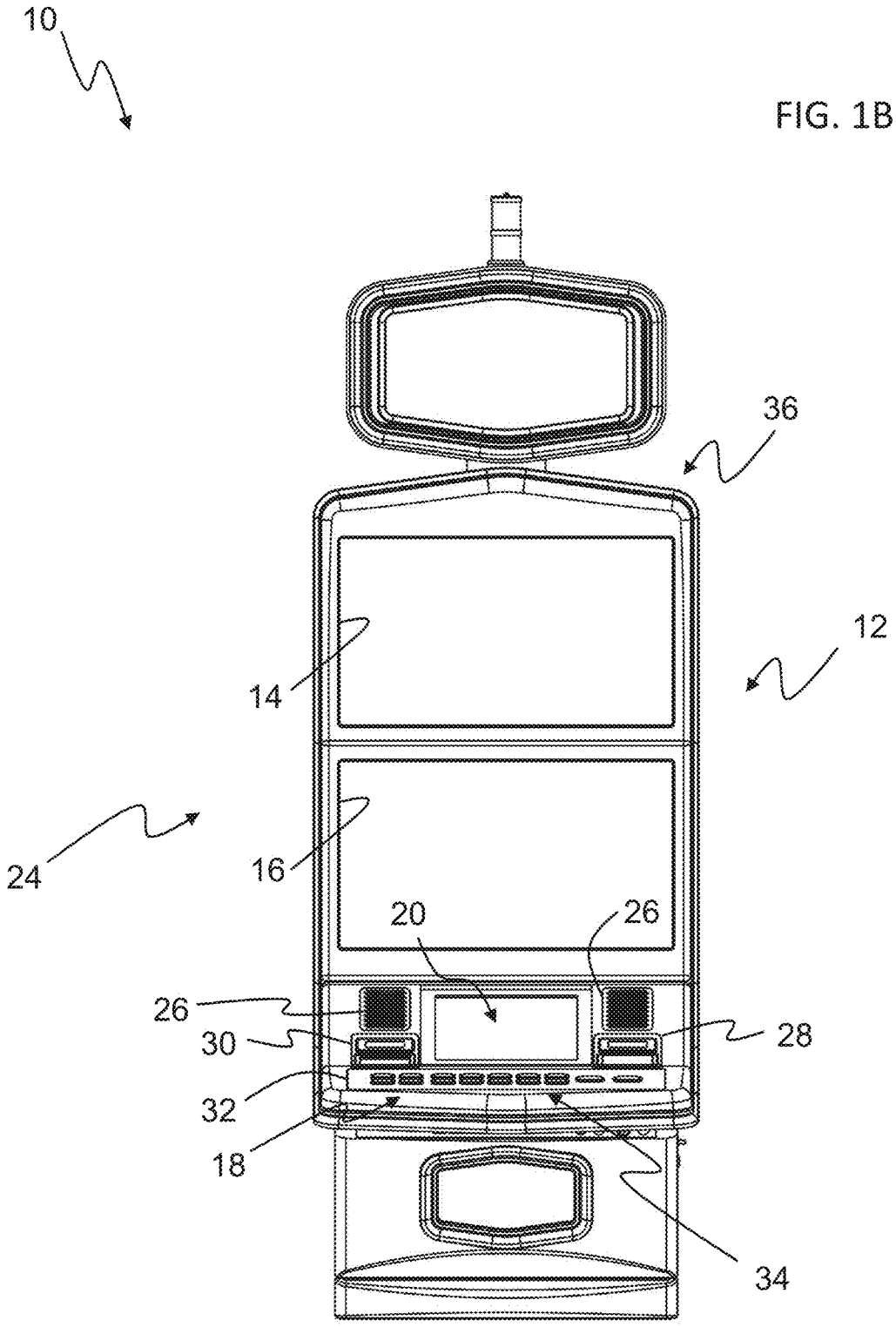
FIG. 1B is a front view of the gaming machine of FIG. 1A.

The gaming machine according to the present embodiment, receives a predetermined game value from the player, generates a game result, and provides a payout to the player according to the game result and one or more pay tables. FIG. 1A and FIG. 1B are a perspective view and a front view, respectively, of a gaming machine 10, according to the present embodiment. As shown in FIGS. 1A and 1B, this gaming machine 10 provides a cabinet 12 providing an upper display 14, a lower display 16, and a control panel 18 and may also house a player tracking or ranking unit 20. The cabinet 12 also houses a game control unit 22 (see FIG. 2) that controls each part (see below). The control unit 22 also implements a random number generator (RNG) that is used during operation of the game. Each configuration is described below.

The upper display 14 and the lower display 16 may be flat panel display devices, such as both liquid crystal display devices and organic EL display devices and the like, and by controlling via each control unit 22, the display area mentioned below functions as a display unit 24 provided to the player.

Speakers 26 are provided on the left and right of the cabinet 12, and by controlling via the control unit 22, sound is provided to the player. On the control panel 18, a bill/ticket identification device 28, a printer device 30, and an operation unit 32 are provided.

The player tracking unit 20 may be housed on the center of the front surface of the cabinet 12 below the lower display 16. The player tracking unit 20 has a card reader that recognizes a player identification card, a display that presents data to the player, and a keypad that receives input by the player. This type of player tracking unit 20 reads information recorded on the player identification card inserted by the player into the card reader, and displays the information and/or information acquired by communicating with the external system on the display, by cooperatively operating with the control unit 22 mentioned below or an external system. Further, input from the player is received by the keypad, the display is changed according to the input, and communication with the external system is carried out as necessary.

The bill/ticket identification device 28 is disposed on the control panel 18 in a state where the insertion opening that a bill/ticket is inserted into is exposed, an identification part that identifies a bill/ticket by various sensors on the inside of the insertion opening is provided, and a bill/ticket storage part is provided on the outgoing side of the identification part. The bill/ticket identification device 28, receives and identifies bills/tickets (including vouchers and coupons) that are the game value as a game executing value, and notifies the control unit 22 mentioned below.

The printer device 30 is disposed on the control panel 18 in a state where the ticket output opening that a ticket is output from is exposed, a printing part that prints predetermined information on a printing paper on the inside of the ticket output opening is provided, and a housing part that houses the printing paper inside the paper inlet side of the printing part is provided. The printer device 30, under the control of the control unit 22 mentioned below, prints information on paper and outputs a ticket according to credit payout processing from the gaming machine 10. The output ticket can use the payout credit as game play by being inserted into the bill/ticket identification device 28 of another gaming machine, or, can be exchanged for cash by a kiosk terminal inside of the casino or a casino cage.

The operation unit 32 receives the operation of the player. The operation unit 32 includes a group of buttons 34 that receives various instructions from the player on the gaming machine 10. The operation unit 32, for example, may include a spin button and a group of setting buttons. The spin button receives an instruction to start (start rotating the reel) an instance of the game. The group of setting buttons 34 includes a group of bet buttons, a group of line-designation buttons, a max bet button, and a payout button and the like. The group of bet buttons receives an instruction operation regarding the bet amount of credits (bet number) from the player. The group of line-designation buttons receive an instruction operation that designate a pay line subjected to a line judgment below from the player. The max bet button receives an instruction operation regarding the bet of the maximum amount of credits that can be bet at one time from the player. The payout button receives an instruction operation instructing a credit payout accumulated in the gaming machine 10. The gaming machine 10 also includes illumination devices 36 that provides decorative lighting to the gaming machine 10.

In one embodiment, referring to FIGS. 1A and 1B, the control panel 18 includes a plurality of user input devices that may include an acceptor device which accepts media associated with a monetary value to establish a credit balance, a validator configured to identify the physical media, a cash-out button actuatable to cause an initiation of a payout associated with the credit balance. The acceptor device may include a touchscreen display associated with the display unit 24 and/or the player tracking unit 20, the paper money/ticket identification device 28, the operation unit 32, the player tracking unit 20, a coin slot, a ticket in ticket out (TITO) system, a bill acceptor, and/or any suitable device that enables the gaming machine 10 to receive media associated with a monetary value and establish a credit balance for use in playing the gaming machine 10. In one embodiment, the acceptor device may be configured to receive physical media such as, for example, a coin, a medal, a ticket, a card, a boll, currency, and/or any suitable physical media that enables the gaming machine 10 to function as described herein. The acceptor device may also be configured to accept virtual media such as, for example, a player tracking account, a virtual credit balance, reward points, gaming credits, bonus points, and/or any suitable virtual media that enables the gaming machine 10 to function as described herein.

For example, in one embodiment, the coin slot may include an opening that is configured to receive coins and/or tokens deposited by the player into the gaming machine 10. The control unit 22 converts a value of the coins and/or tokens to a corresponding amount of gaming credits that are used by the player to wager on games played on the gaming machine 10. The bill acceptor may include an input and output device that is configured to accept a bill, a ticket, and/or a cash card into the bill acceptor to enable an amount of gaming credits associated with a monetary value of the bills, ticket, and/or cash card to be credited to the gaming machine 10. In one embodiment, the bill acceptor also includes a printer (not shown) that is configured to dispense a printed voucher ticket that includes information indicative of an amount of credits and/or money paid out to the player by the gaming machine 10 during a gaming session. The voucher ticket may be used at other gaming devices, or redeemed for cash, and/or other items as part of a casino cashless system.

Figure 2:
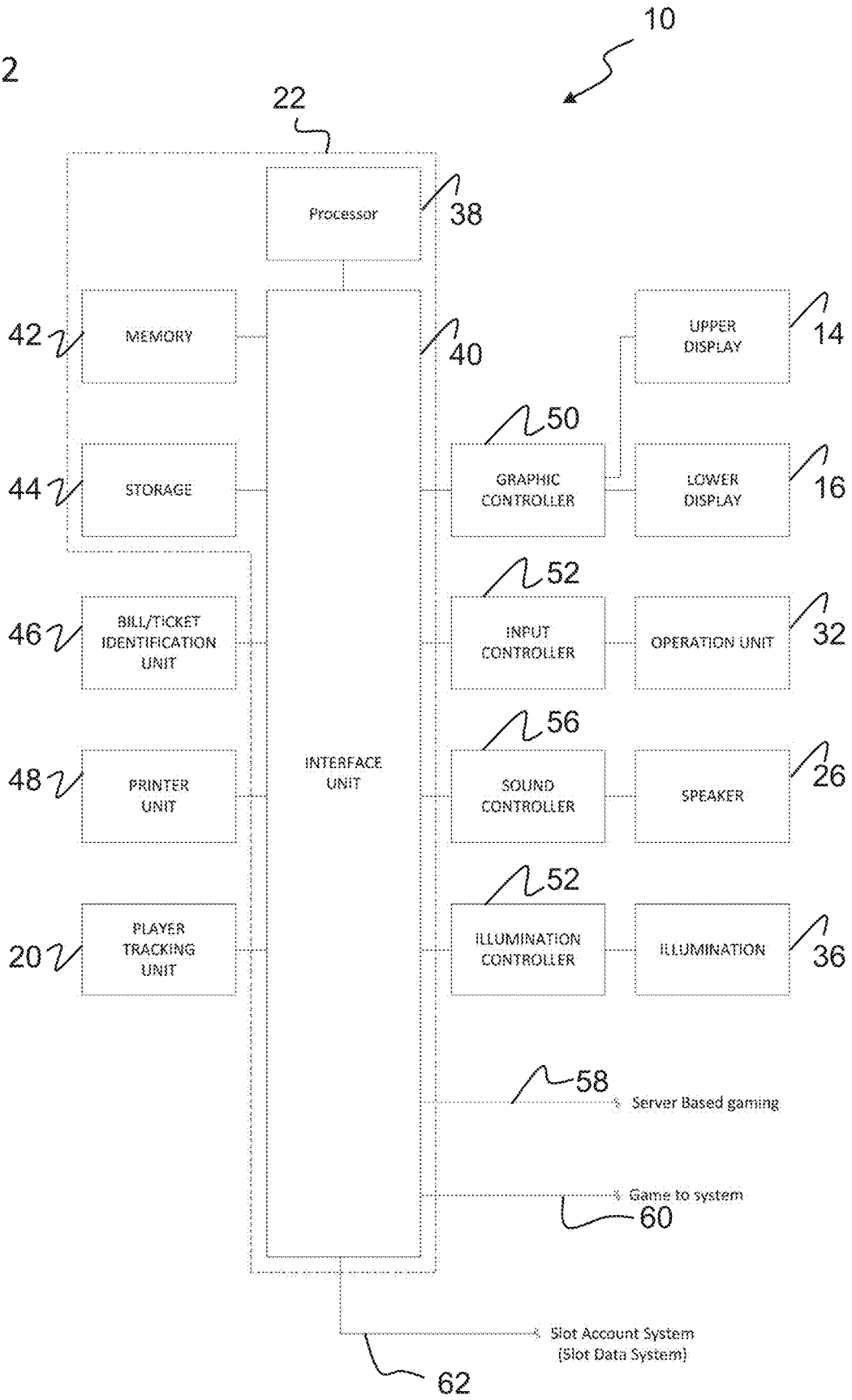
FIG. 2 is a functional block diagram of the gaming machine in FIG. 1A.

With reference to FIGS. 1A, 1B, and 2, further on the inside of cabinet 12, a control board equipped with a central processing unit 38 (abbreviated as CPU below) including a processor that configures the control unit 22, an interface unit (or part) 40, a memory 42 and a storage 44 and the like are incorporated. The control board is configured so that communication is possible through the interface unit 40 and each of the components equipped on the cabinet 12, controls the operation of each part by executing the program recorded in the memory 42 or the storage 44 of the CPU 38, and provides a game to the player. The function of the CPU 38 is to execute and display the game on the displays 14, 16 of the gaming machine 10.

FIG. 2 shows a functional block diagram of the gaming machine 10, according to the present embodiment. The gaming machine 10 provides the control unit 22. The control unit 22 is configured as the interface unit 40 including a chip set providing communication functions of the CPU 38, a memory bus connected to a CPU 38, various expanding buses, serial interfaces, USB interfaces, Ethernet (registered trademark) interfaces and the like, and a computer unit where the CPU 38 provides the addressable memory 42 and the storage 44 through the interface unit 40. The memory 42 can be configured to include RAM that is a volatile storage medium, ROM that is a nonvolatile storage medium, and EEPROM that is a rewritable nonvolatile storage medium. The storage 44 provides the control unit 22 as an external storage device function, can use reading devices such as a memory card that is a removable storage medium, and a magneto optical disk and the like, and can use hard disks.

On the interface unit 40, in addition to the CPU 38, the memory 42, and the storage 44, a bill/ticket identification unit controller 46, a printer unit controller 48, the player tracking unit 20, a graphic controller 50, an input controller 52, and a sound controller 54 are connected. That is, the control unit 22 is connected to the operation unit 32 through the input controller 52, and connected to the upper display 14 and/or the lower display 16 through the graphic controller 50. Further, when illumination devices 36 that provides decorative lighting to the gaming machine 10 is provided, the illumination is controlled under the control of the control unit 22 on the interface unit 40, and an illumination controller 56 that controls the illumination devices 36 to provide a decorative lighting effect may be connected.

The control unit 22, which includes memory 42 and storage 44, controls each part by executing a program stored in the memory 42 and the storage 44, and provides a game to the player. Here, for example, the memory 42 and storage 44 may be configured to store a program and data of an operating system and subsystem that provide the basic functions of the control unit 22 to the EEPROM of the memory 42, and stores a program and data of an application that provides a game to the storage 44. According to such a configuration, it can be easy to change or update a game by replacing the storage 44. Further, the control unit 22 may be a multiprocessor configuration that has a plurality of CPUs.

Each block connected to the control unit 22 is described below. The bill/ticket identification unit controller 46 operates the bill/ticket identification device 28 to receive bills/tickets in the insertion opening, and notifies the control unit 22 of identifying information corresponding to the assortment of bills or the payout processing of credits. The bill/ticket identification unit controller 46 notifies the information to the control unit 22, and the control unit 22 increases the usable credit amount inside of the game according to the notified content. The printer unit controller 48 corresponds to the printer device 30, and under the control of the control unit 22 that receives an operation of the payout button of the group of setting buttons 34, information corresponding to the credit payout processing from the gaming machine 10 is printed and output on a printed ticket.

The player ranking (or tracking unit) unit 20 cooperatively operates with the control unit 22, and sends and receives information and the like of the player from the casino management system. The graphic controller 50 controls the upper display 14 and the lower display 16, under the control of the control unit 22, and displays a display image that includes various graphic data. The sound controller 54 drives the speakers 26 under the control of the control unit 22, and provides various sounds such as an announcement, sound effects, BGM and the like.

Further, the interface unit 40, has various communication interfaces for communicating with the exterior of the gaming machine 10, for example the interface unit 40 can communicate with an external network by Ethernet 58, 60, and a serial interface 62. In the present embodiment, one example shows when there is communication between a well-known server side gaming network (Server Based Gaming of FIG. 2), a G2S network (Game to System of FIG. 2), and a slot information system (Slot Data System of FIG. 2), respectively.

Figure 3:
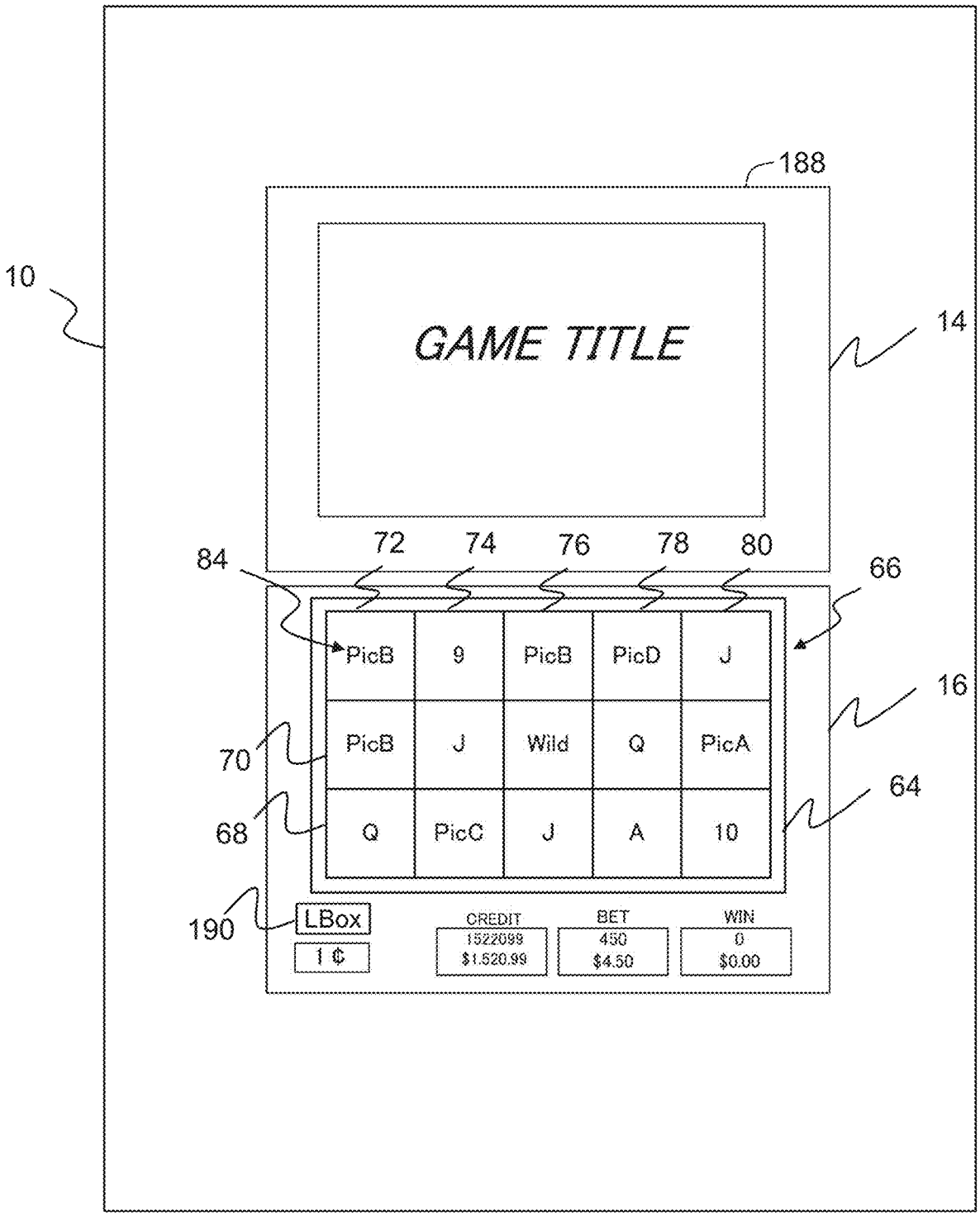
FIG. 3 is a first diagrammatic illustration of a display area of the gaming machine in FIGS. 1A-2, according to an embodiment of the present invention.

FIG. 3 schematically shows a display area 64 provided by the gaming machine 10. Such a display area 64 is displayed on the display unit 24 (the upper display 14 and/or the lower display 16) by the control unit 22 executing a predetermined program. In the illustrated embodiment, the display area 64 is displayed on the lower display 16. For instance, as shown, during a game, the upper display 14 may be utilized to display game related information, e.g., game title information and/or graphics.

In one aspect of the present invention, the gaming machine 10 provides a video slot game using a plurality of virtual reels 66. The video slot game utilizes a grid 68 in the display area 64. The illustrated embodiment shows the state of displaying the display area 64 in the lower display 16. As shown in FIG. 3, the display area 64 includes the grid 68 for displaying symbols. By using such a display area, the gaming machine 10 of the present embodiment operates as a slot machine that pays a payout according to a winning combination of symbols displayed on the display area 64.

The display unit 24 displays a plurality of symbols in the grid 68. The grid 68 has a plurality of rows (r) and columns (c). The grid 68 is configured by a plurality of cells 70 that are the stop position of symbols.

With reference to FIG. 3, the grid 68 may be displayed on the lower display 16. The upper display 14 may be used to display animations and/or game identifying information during the game and/or during an attract mode. Further, the display unit 24 can display a decorative area, and an area that displays credit amount, bet number, and a credit amount obtained by winning (WIN number) and the like, outside of the grid 68. On each of the plurality of cells 70 of the display area 64, one symbol is stopped and displayed.

Figure 4:
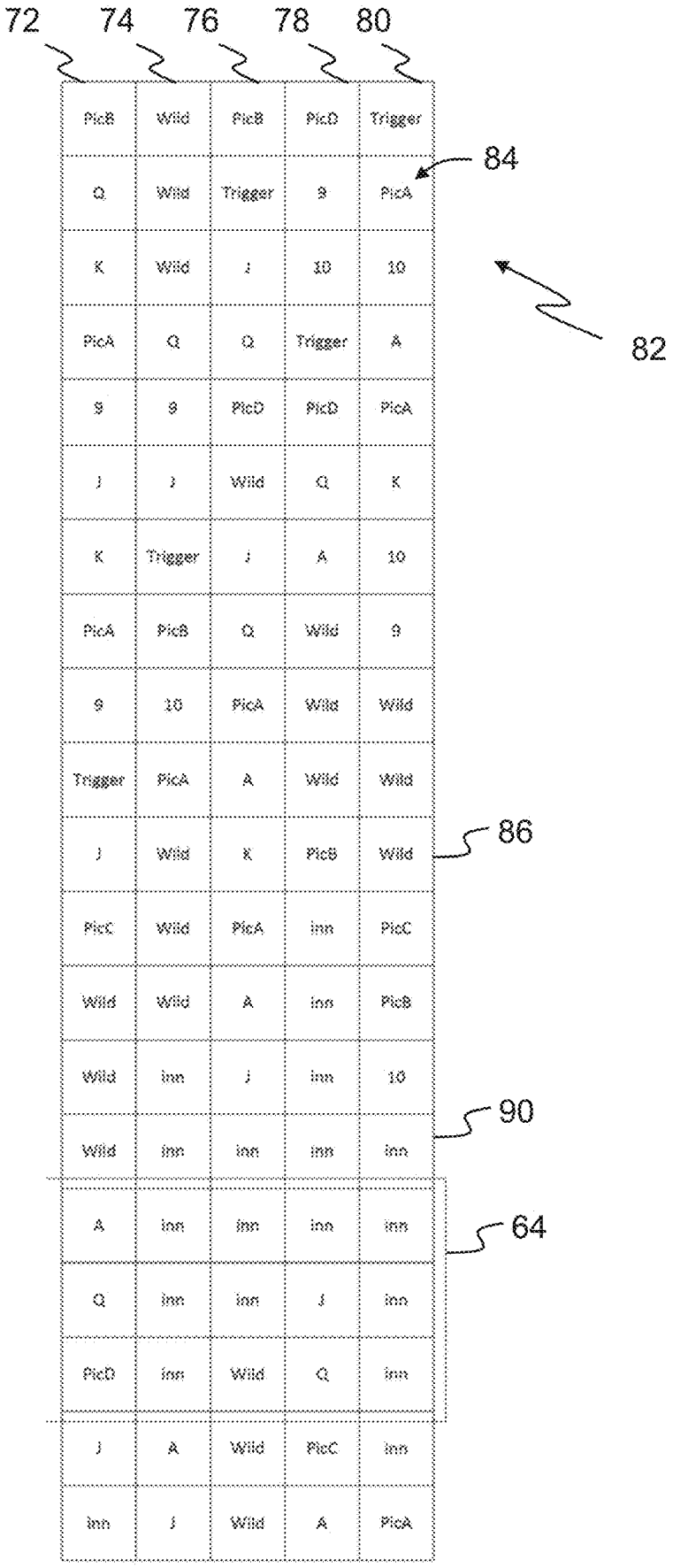
FIG. 4 is an illustration of exemplary virtual reel strips with symbol arrangements showing the order of symbols displayed on the display area, according to an embodiment of the present invention.

On each cell 70 of the grid 68, as shown in FIGS. 3 and 4, a symbol is displayed based on the symbol arrangement of virtual reels 66 including virtual reel strips 72, 74, 76, 78, and 80 configured as a virtual reel set 82. That is, the cells 70 of the grid 68 correspond to the virtual reel strips 72 to 80 by column, and the symbols disposed on predetermined parts of each virtual reel strip 72 to 80 are displayed. Furthermore, by moving (scrolling or spinning) each symbol by column based on the symbol arrangement of the virtual reel strips 72 to 80, the symbols displayed in the cells 70 of the grid 68 change, and by stopping the movement (scrolling or spinning) by columns, the symbols are stopped. Here, the virtual reel strips 72 to 80 are data where the control unit 22 uses a program having the memory 42 or the storage 44, and data showing the symbol arrangement (i.e., the order of symbols on each reel strip) regulated by each cell column. Further, the virtual reel set 82 is a general term for such virtual reel strips 72 to 80.

Figure 5:
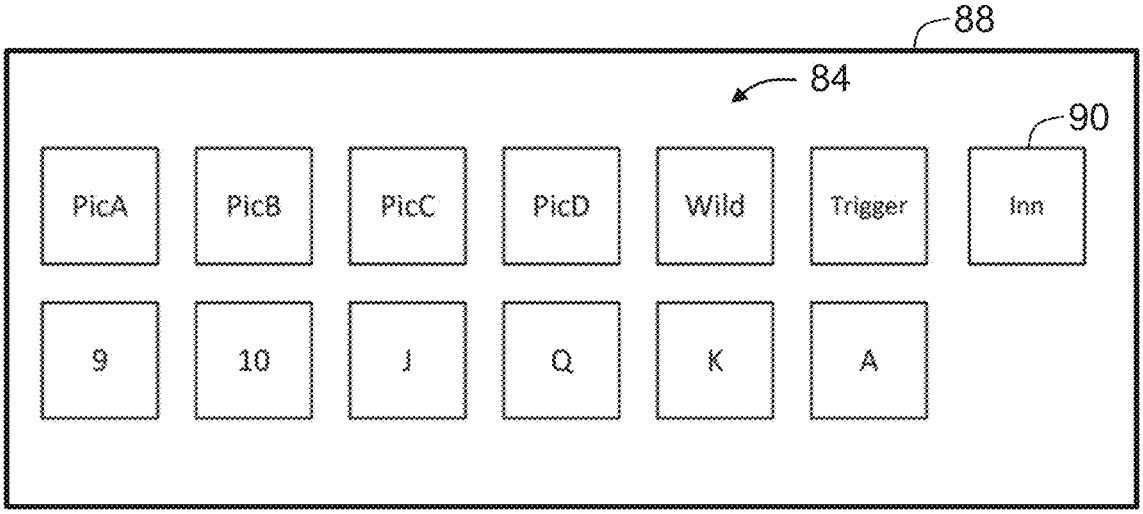
FIG. 5 is a figure showing the symbols displayed on the display area, according to an embodiment of the present invention.

Each virtual reel strip 72 to 80, in the examples of FIG. 4, may be configured by 20 symbols 84 in respective symbol positions 86, and those symbols are aligned in an order defined by each reel. FIG. 5 is the details of symbols 84 of the figure shown in FIGS. 3 and 4. Each virtual reel strip 72 to 80 includes symbols selected from a symbol set 88 of varieties of symbols 84 shown in FIG. 5. This symbol set 88 includes card symbols ("9", "10", "J", "Q", "K", and "A") that imitate playing cards as regular symbols, and picture symbols ("PicA", "PicB", "PicC", and "PicD") that show a pattern. Further, this symbol set 88 includes a wild symbol ("Wild") that is substituted as another symbol when a win combination is determined and a trigger symbol ("Trigger") that may be used to determine if a game feature is to be provided. Each of these symbols have a different rank from each other regarding their value when winning, their rank gradually raises in this order: "9", "10", "J", "Q", "K", "A", "PicE", "PicD", "PicC", "PicB", "PicA". A combination of symbols that includes high-ranking symbols when winning, can obtain a larger winning payout compared to a combination of low-ranking symbols when winning.

Returning to FIG. 4, in one embodiment, some of the symbol positions have a fixed symbol and others of the symbol positions have a varying symbol, represented by a varying inner symbol 90 ("inn"). In the illustrated embodiment, for each play of the game, the fixed symbol positions have an associated predefined symbol from the set of symbols 84, and the varying symbol 90 has a symbol that is randomly selected from the symbol set 88. For example, in one embodiment of the present invention, for each play of a game, one of the symbols from a sub-group of symbols included in the symbol set 88 is randomly selected and associated/displayed in the varying symbol positions 86. The sub-group may include, for example, "PicA", "PicB", "PicC", "PicD", "PicE", "A", "K", "Q", "J", "10", and "9". In one embodiment, the same randomly selected symbol from the second sub-group of symbols is associated with or displayed in the varying symbol positions.

In another aspect of the present invention, all of the varying symbol positions or feature symbol positions (indicated as "inn") are arranged in groups (or stacks) of adjacent symbol positions (within a reel strip).

It should be noted that in one aspect of the present invention, one or more dynamic virtual reel strips may be utilized. Using virtual reel strips, the symbols and/or symbol positions and/or virtual reel strips and/or length or size and/or any aspect of a virtual reel strip may change from one spin or play to the next. For example, a dynamic reel strip includes a plurality of symbol positions with symbols from the symbol set 88 and a plurality of varying symbol positions ("inn"). The varying symbol positions may be in the form of one or more stacks, i.e., adjacent symbol positions. In one embodiment, the location and/or size of the stacks may change from one spin to the next, either randomly and/or in a predetermined pattern.

Alternatively, a virtual reel strip associated with a cell 70 (or column of cells 70) may be dynamically changed from one spin or play to another spin or play. This, may occur randomly, every spin or play and/or in a predetermined pattern.

It should be noted that in the illustrated embodiment, each column of the grid 68 has a corresponding reel strip. When the reel strip stops, a symbol from the respective reel strip appears in each one of the cells of the respective column of the grid 68. One or more of the reel strip 72 to 80 may be identical or all of the reel strip 72 to 80 may be different.

In an alternative embodiment, however, each cell 70 of the grid 68 has a respective independent reel that may spin independently of the other reels. Each cell 70 of the grid 68 may, thus, have an independent reel with a corresponding virtual reel strip 72 to 80. The virtual reel set 82 may include different number of virtual reel strips in such a case. For example, in an example in which a 3×5 grid is utilized, each cell 70 would have an associated virtual reel strip, so fifteen reel strips would be utilized. As above, one or more of the fifteen virtual reel strips may be identical or all reel strips may be different.

In the next several embodiments, the present invention will be described with respect to a 3×5 grid, however, it should be noted that the present invention is not limited to a grid with any specific size and/or shape.

In general, the control unit 22 starts a game and determines the stop position of each virtual reel strip 72 to 80 randomly. The virtual reel strips 72 to 80 that are displayed in the display unit 24 (for example, the lower display 16) are moved from a current position, and stopped based on a stop position to express an outcome of the game. Due to this, in the display or grid 68, the symbols included on the virtual reel strips 72 to 80 are continuously moved (scrolled or spun) in a vertical direction of the display area 64, and one symbol of one cell 70 is aligned in an order of the symbol based on the symbol arrangement is stopped so that it is displayed.

The control unit 22 changes and stops the plurality of symbols displayed on the display unit 24 according to the operation of the player received by the operation unit 32, and a payout may be paid according to the stopped symbols inside the display area 64.

In the display area 64, a pay line is set that is used when winning is determined. The pay line is set to be extended over the column on the right end from the cells of the column of the left end, and is a line that combines the plurality of cells 70 determining a win. The number of effective lines within the set pay line is selected by the operation of a group of line designation buttons included in the group of setting buttons 34 of the operation unit 32 for the player. The control unit 22, in regards to the result of a game that is a combination of symbols, determines a win when a predetermined number of identical symbols is surpassed and aligned on a set pay line, and pays a payout to the player according to the type and number of symbols. On the gaming machine 10 of the present embodiment, a predetermined number of pay lines (LINE 1-40) of cells with three rows and five columns in the display area 64 is set (see FIG. 3). The system for determining a win may determine a win when a predetermined number of identical symbols from cells of the column on the left end are aligned on a set pay line, may determine a win when a predetermined number of identical symbols from cells of the column on the right end are aligned on a set pay line, and may determine a win when a predetermined number of identical symbols are aligned on a continuous column on a predetermined pay line. In addition, more than a predetermined number of the "Trigger" form a win combination or trigger condition regardless of the pay line.

Figure 6:
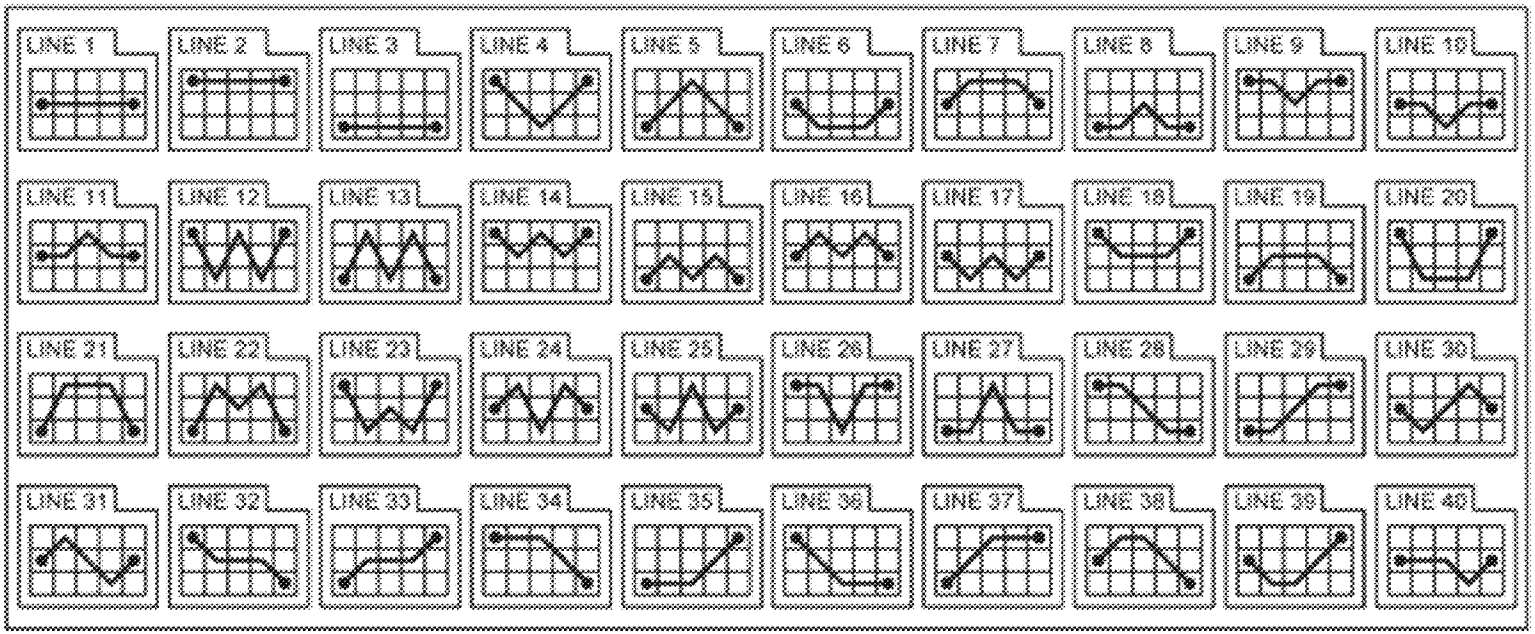
FIG. 6 is a figure showing one example of a pay line set on the determination area in FIG. 5.
Figure 7:
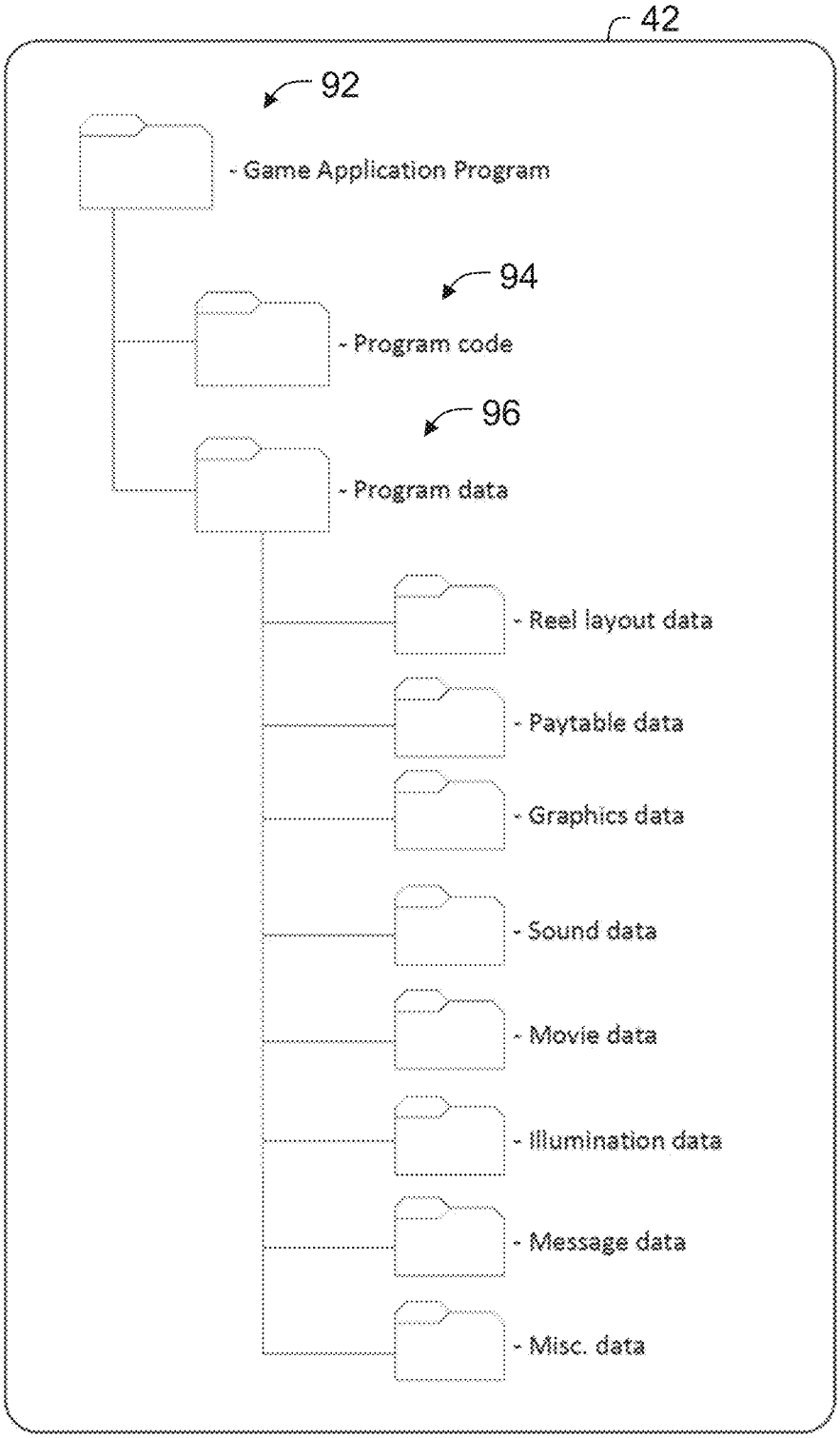
FIGS. 7-10 are block diagrams of a game control unit that may be used with to perform the function of executing a game on the gaming machine shown in FIG. 1A-2.
Figure 8:
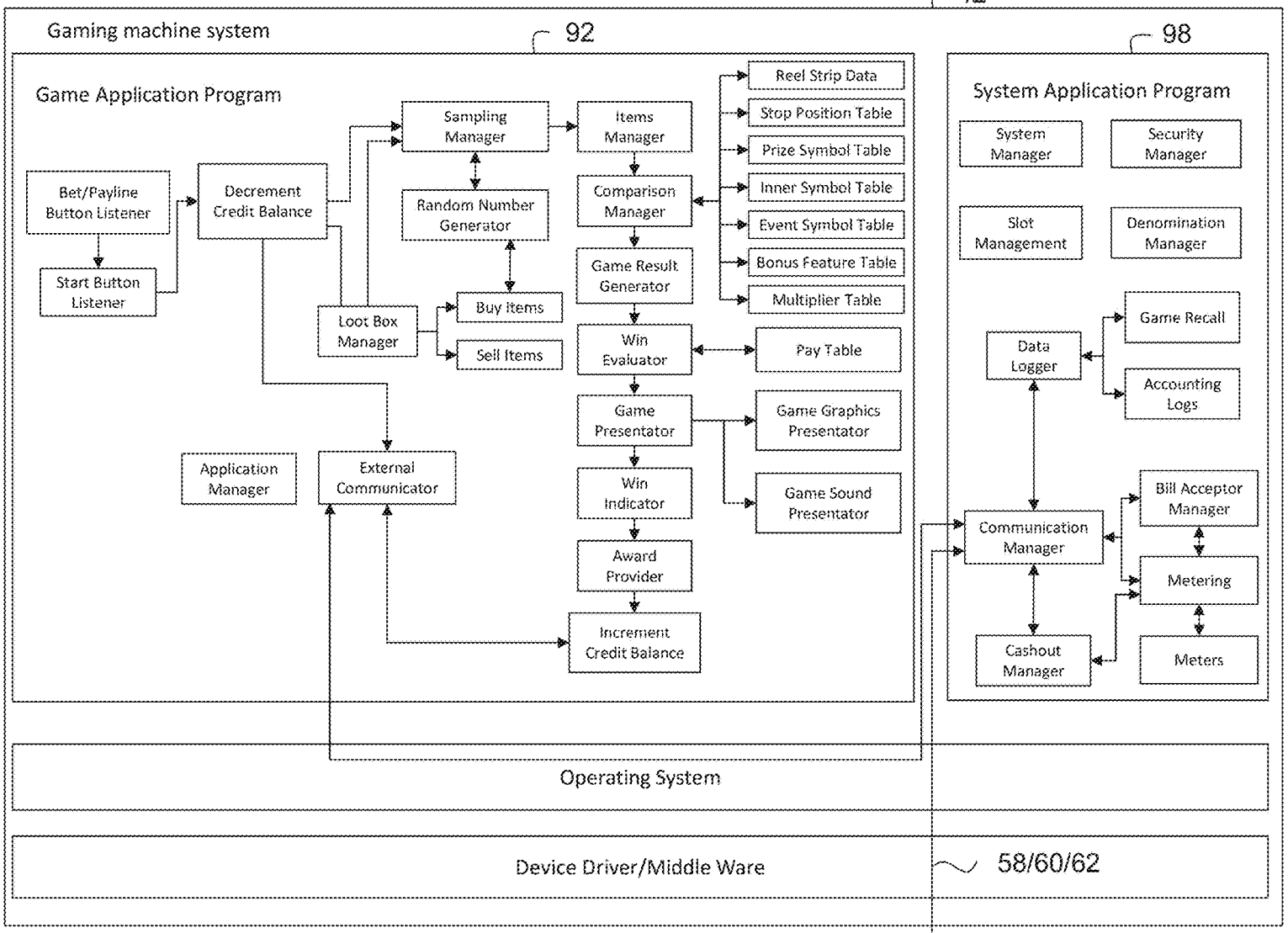
Figure 9:
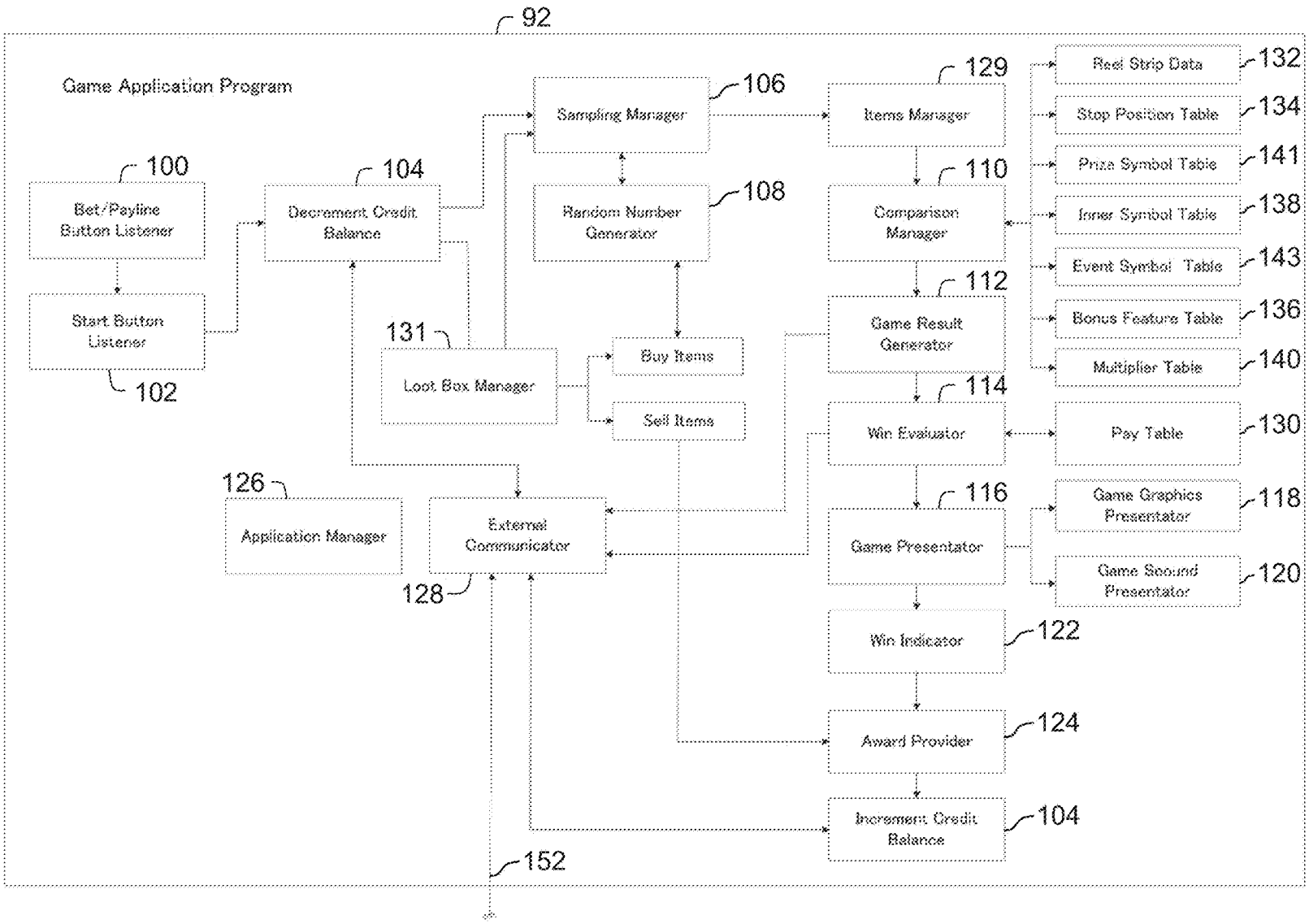
Figure 10:
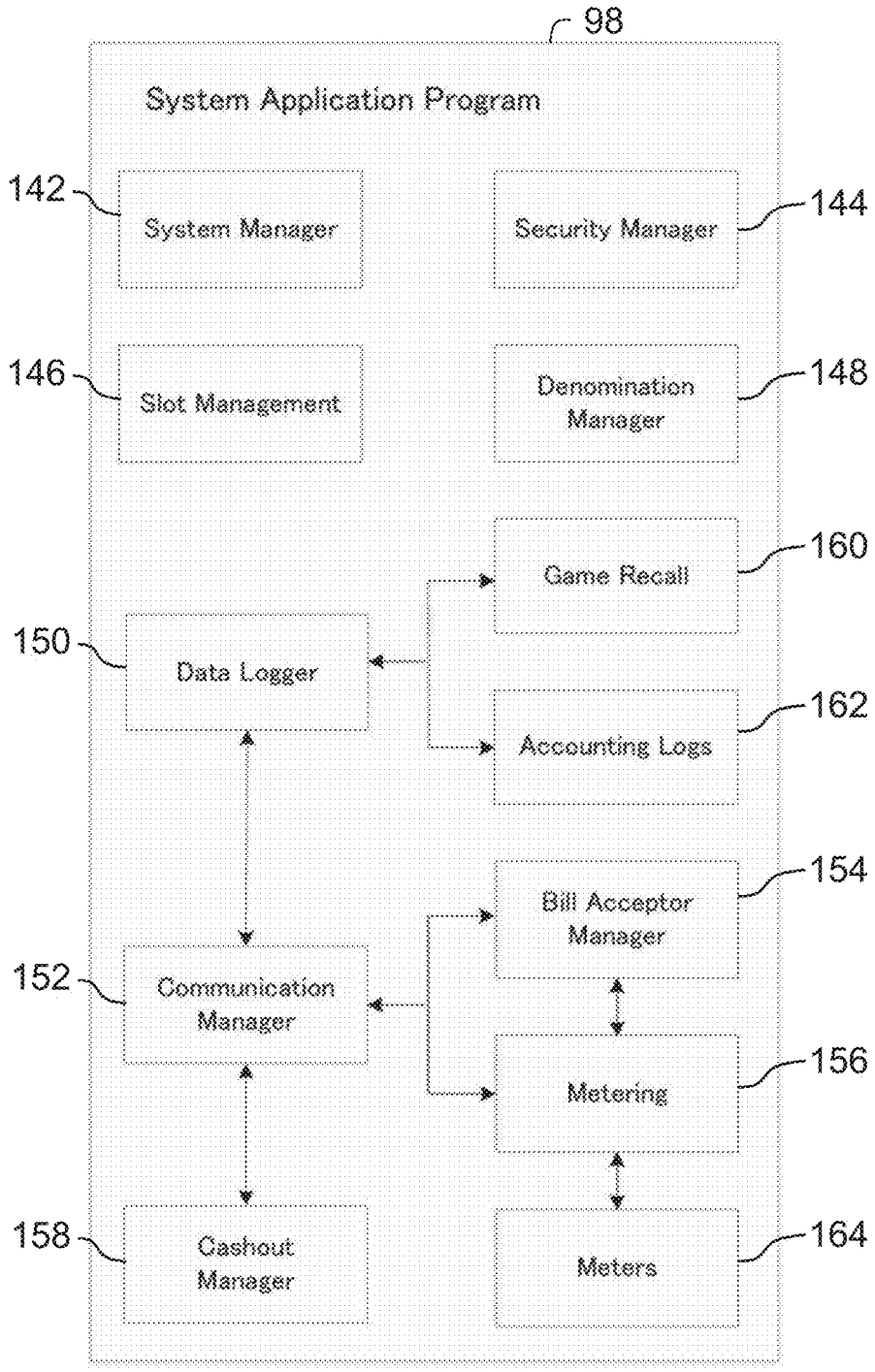

It should be noted that pay lines shown other than (or in addition to) the pay lines shown in FIG. 6 may be used. In general, the pay lines shown in FIG. 6 start in the first column and end in the last column, and include one cell per column. However, one or more pay lines could include one or more cells in the same column and may include a vertical pay line.

Referring to FIGS. 7-10, in the illustrated embodiment, the memory 42 stores a game application program 92 that includes computer executable instructions that, when executed by the processor 38, cause the processor 38 to generate and display the game on the display unit 24 of the gaming machine 10. In one embodiment, the game application program 92 includes program code 94 and program object data 96 that includes computer executable instructions for implementing a game using the algorithms shown in FIGS. 13-18.

In the illustrated embodiment, the memory 42 stores the game application program 92 and a system application program 98 that includes computer executable instructions that, when executed by the processor 38, cause the processor 38 to generate and display the game on the display unit 24 of the gaming machine 10. The application program 92 provides game specific/front-end functions and the system application 98 program provides generic/back-end functions, when executed by the processor 38. In the illustrated embodiment, the application program 92 and the system application program 98 are implemented on the same operating system. However, it should be noted that these programs may be implemented on different operating system and/or by different processors. In one embodiment, the game application program 92 includes a plurality of software modules including a bet/payline button listener module 100, a start button listener module 102, a credit balance manager module 104, a sampling manager 106, a random number generator 108, a comparison manager 110, a game result generator 112, a win evaluator 114, a game presentator 116, a game graphics presentator 118, a game sound presentator 120, a win indicator 122, an award provider 124, an application manager 126, an external communicator 128, an items manager 129, and a loot box manager 131. The game application program 92 may also include a pay table 130, a reel layout table 132, a stop position table 134, a bonus feature table 136, an inner symbol table 138, and a multiplier feature table 140, a prize symbol table 141, and an event symbol table 143.

The bet/payline button listener module 100 is a software module for receiving a signal from the bet button or the payline button which is generated by the button when a player operates the button to select number of bet or number of paylines. In response to receiving the signal, the bet/payline button listener module 100 communicates the occurrence of the signal to application manager 126 for changing bet or payline configuration of the game.

The start button listener module 102 is a software module for receiving a signal from the start button which is generated by the button when a player operates the button to start a game. In response to receiving the signal, the start button listener module 102 communicates the occurrence of the signal to application manager 126 for starting the game.

In response to receiving the signal from start button listener module 102, the application manager 126 requests the sampling manager 106 to obtain necessary number of random numbers from the random number generator 108.

The random number generator 108 generates random numbers based on predetermined algorithm of computational random generation method. The random number generator 108 may be a pseudorandom generator. In response to a request from sampling manager 106, the random number generator 108 returns random number. In some implementations, the random number generator 108 may be implemented in a central server. The random number generator 108 may be implemented as an integrated circuit or hard wired logic.

The comparison manager 110 compares the current state of the game or each random number with the reel layout table 132, the stop position table 134, the bonus feature table 136, the inner symbol table 138, the multiplier feature table 140, the prize symbol table 141, and/or the event symbol table 143 and specifies corresponding reel layout, stop position, prize symbol, inner symbol or event symbol based on each random number.

The reel layout table 132 (also shown in FIG. 27) includes a set of virtual reels strips for a primary game and a free game bonus. The comparison manager 110 inquires the application manager to identify current state of the game and select the sets of virtual reel strips.

The stop position table 134 (also shown in FIG. 28) includes a random number range associated with each stop position of a virtual reel strip. The comparison manager 110 identify a stop position of each reel based on corresponding random number and the stop position table 134.

The bonus feature tables 136 (also shown in FIGS. 29-30) includes a random number range and/or selection probability associated with a plurality of bonus features. The comparison manager 110 identify a bonus feature based on corresponding random number and the bonus feature tables 136.

The inner symbol table 138 (also shown in FIG. 31) includes a random number range associated with each stop position of a virtual inner reel. The comparison manager 110 identifies a stop position of the virtual inner reel based on corresponding random number and the inner symbol table 138.

The multiplier feature tables 140 (also shown in FIGS. 32-33) includes a random number range and/or selection probability associated with a plurality of multiplier values. The comparison manager 110 identifies a multiplier value based on corresponding random number and the multiplier feature tables 140.

The prize symbol table 141 and event symbol table 143 includes a random number range and/or selection probability associated with a plurality of prize symbols and event symbols, respectively, that are used in generating a reel strip layout.

The game result generator 112 generates game result based on selected reel layout, stop positions of each reel, stop position of inner symbol, and bonus features.

The win evaluator 114 evaluates the game result with reference to the pay table 130.

The game presentator 116 provides game presentation process with visual and sound so as to form the predetermined game result finally.

The game graphics presentator 118 provides visual game presentation process on the display so as to form the predetermined game result finally.

The game sound presentator 120 provides sound presentation process by using sound controller and speakers.

The win indicator 122 indicates win combinations and payment condition of prize symbol formed in the game result.

The award provider 124 provides award credit to win meter based on the win evaluation.

The application manager 126 administrates activity and status of each software module. In addition, the application manager 126 administrates configuration, progress and states of the game application program 92.

The external communicator 128 communicates instruction and data with the system application program 98.

The credit balance manager module 104 executes a process for decrementing credit balance and incrementing credit balance based on win amount displayed in win meter.

The pay table 130 includes a prize associated with each win combination.

The loot box manager module 131 functions to execute the bonus feature selection game (shown in FIGS. 19-26D) by executing the algorithms shown in FIGS. 13-18.

In the illustrated embodiment, the system application program 98 provides back ground processing and functions other than game specific functions. The system application program 98 includes a plurality of software modules including a system manager 142, a security manager 144, a slot management module 146, a denomination manager 148, a data logger 150, a communications manager 152, a bill acceptor manager 154, a metering module 156, and a cashout manager 158.

The system application program 98 may also include a game recall file 160, accounting logs 162, and meters 164.

The system manager 142 is a software module for administrating all of the back ground processing and functions other than game specific functions conducted by the system application program 98.

The security manager 144 is a software module for administrating game verification, door security and monitoring security sensors.

The slot management module 146 is a software module for administrating data accumulation and communicating with external slot information system 62.

The denomination manager 148 is a software module for establishing denomination setting of the gaming machine 10. The denomination setting may include 1 cent, 2 cent, 5 cent, 25 cent, 1 dollar, 5 dollar and the like.

The data logger 150 is a software module for logging result of each primary game and the free game bonus to the game recall. In addition, the data logger 150 stores error events, bill log, cashout log, ticket log etc. to the accounting log.

The game recall file 160 is an accumulated data including results of each primary game and free game bonus. The game recall file 160 is stored in a non-volatile memory.

The accounting logs 162 is an accumulated data including error events, bill log, cashout log, ticket log etc. The accounting logs 162 are stored in a non-volatile memory.

The communications manager 152 is a software module for administrating communication between game application program 92 and system application program 98. The communications manager 152 also administrates network communication between system application program 98 and external network such as slot management system network, G2S network, gaming server for server based gaming network or VLT system network.

The bill acceptor manager 154 is a software module for administrating the bill acceptor and receives bill information inserted in the bill acceptor. In response to receiving the information from the bill acceptor, the bill acceptor manager 154 communicates with the metering for incrementing credit balance based on the inserted bill.

The metering module 156 is a software module for adjusting values of the meters 164 in response to communication with the game application program 92 via communications manager 152, the bill acceptor manager 154 or the cashout manager 158. The meters 164 includes a credit meter for indicating current credit balance on the gaming machine and an win meter for indicating win amount of current game session. The meters further include back ground meters such as coin-in, coin-out, total drop, attendant paid jackpots and/or bill-in. These meters might be implemented as data on the non-volatile memory or hardware meters.

The cashout manager 158 is a software module for administrating cashout procedure. In response to a player's operation on the cashout button, the cashout manager 158 is activated and the gaming machine pay total amount of the credit meter.

Figure 11:
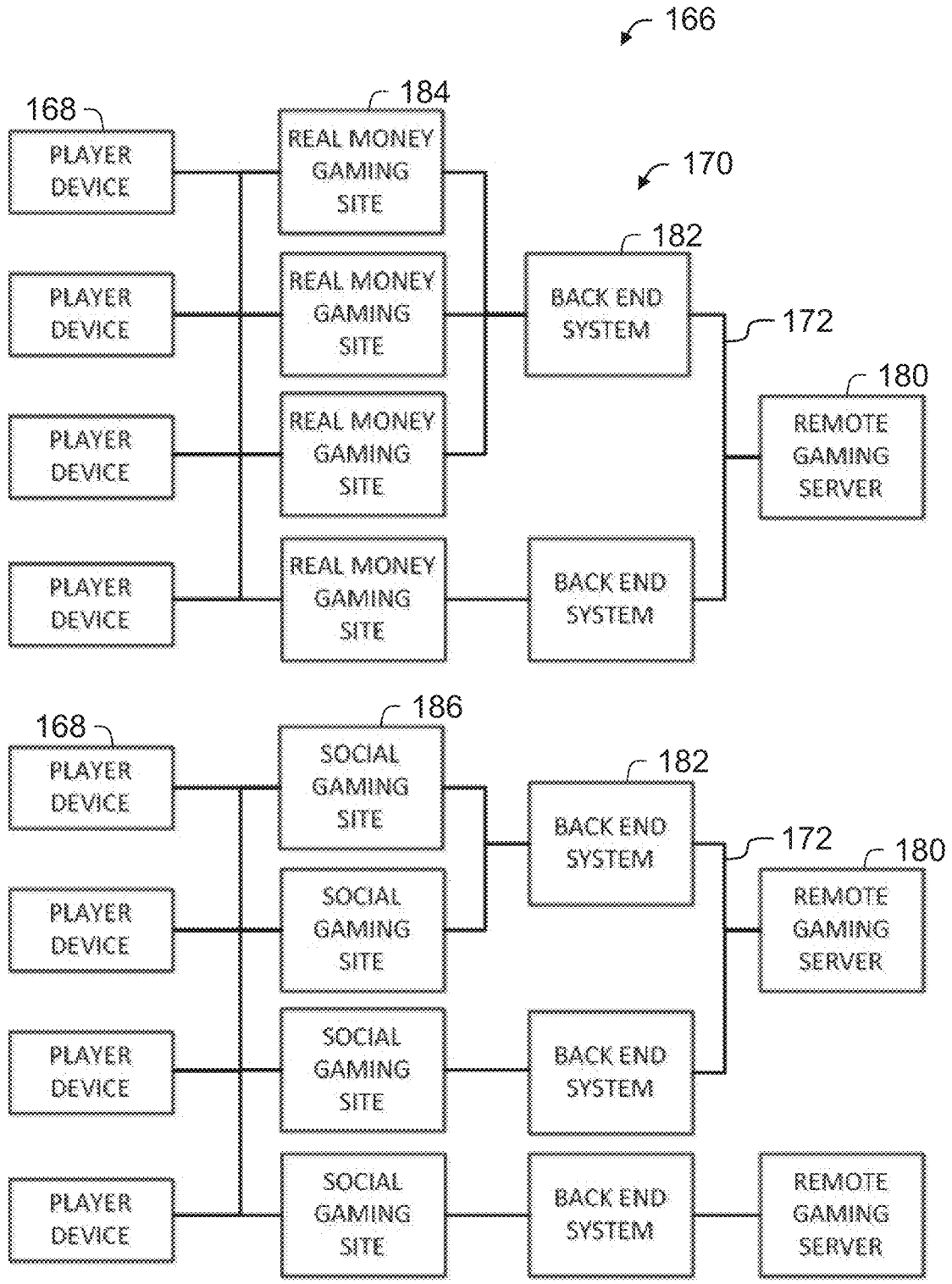
FIG. 11 is a functional block diagram of a server computer system, according to an embodiment of the present invention.
Figure 12:
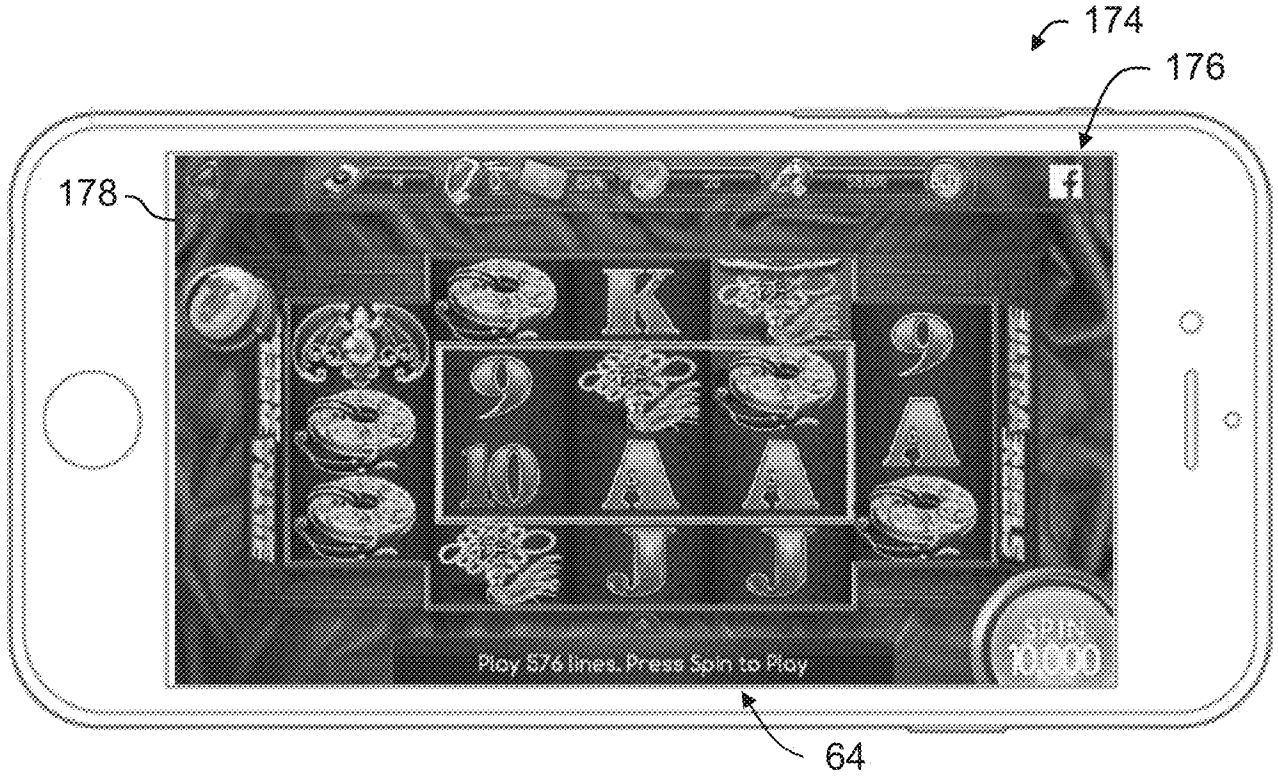
FIG. 12 is a front view of a mobile computing device that may be used with the server computer system of FIG. 11.

Referring to FIGS. 11 and 12, in one embodiment, the present inventions includes an networked server computer system 166 that is configured to deliver the game to one or more client computing devices 168 over the Internet. In the illustrated embodiment, the networked computer system 166 includes an iGaming server system 170 that is coupled in communication with one or more client computing devices 168 via a communications network 172. The communications network 172 may be any suitable connection, including the Internet, an Intranet, LAN, a virtual private network (VPN), cellular networks, etc. . . . , and may utilize any suitable or combination of technologies including, but not limited to wired and wireless connections, always on connections, connections made periodically, and connections made as needed.

The client computing device 168 may include any suitable device that enables a user to access and communicate with the server system 170 including sending and/or receiving information to and from the server system 170 and displaying information received from the server system 170 to a user. In the illustrated embodiment, the client computing device 168 includes a processor coupled to a memory device. The memory device stores various programs and data that are executed by the processor for operating the client computing device 168. The client computing device 168 also includes an input device configured to receive operational inputs from the user, and a display device configured to display a graphical user interface. The input device and display device enable a user to interact with the server system 170 via the client computing device 168. For example, in one embodiment, the client computing device 168 may include, but is not limited to, a desktop computer, a laptop or notebook computer, a tablet computer, smartphone/tablet computer hybrid, a personal data assistant, a handheld mobile device including a cellular telephone, and the like. In one embodiment, the processor of the client computing device 168 may be programmed to function as the control unit 22 of the gaming machine 10.

In the illustrated embodiment, the client computing device may include a web browser program stored in the memory device. The processor executes the web browser program to display web pages on the display device that includes information received from the server system 170 to enable a user to interact with and operate the server system 170.

In one embodiment, the client computing device 168 includes a mobile computing device 174 (shown in FIG. 12) such as, for example, a tablet computer, a smartphone/tablet computer hybrid, a smartphone such as an iPhone™, and the like. The mobile computing device 174 includes a processor coupled to a memory device for storing various programs and data for use in operating the mobile computing device 174. The mobile computing device 174 may also include a touchscreen display unit 176, one or more video image cameras, one or more speakers, a microphone, at least one input button, and one or more sensors including, but not limited to, a touch ID fingerprint sensor coupled to an input button, a barometer, a three-axis gyro, an accelerometer, proximity sensor, and an ambient light sensor. In addition, the mobile computing device 174 may also include a Wi-Fi antenna, a cellular network antenna, a Bluetooth™ communications device, assisted GPS and GLONASS, a digital compass, and an iBeacon™ microlocation device.

The mobile computing device 174 may be programmed to store and execute mobile computer program applications that display graphical user interfaces 178 on the touchscreen display unit 176 including display area 64 that allows the user to access the server system 170 to retrieve and store information within the server system 170 as well as interact with and operate the server system 170. In addition, in one embodiment, the server system 170 may install one or more mobile computer application programs in the memory device of the mobile computing device 174. When initiated by the processor of the mobile computing device 174, the mobile computer application program causes the processor of the mobile computing device 174 to perform some or all of the functions of the gaming machine 10.

In the illustrated embodiment, the server system 170 includes one or more remote gaming servers 180, one or more back-end servers 182, one or more real money gaming web site hosting servers 184, and one or more social gaming website hosting servers 186. In the illustrated embodiment, the social gaming website hosting server 186 and the real money gaming website hosting server 184 are programmed to host a website that is accessible by a user via one or more client computing devices 168. The website hosting servers 184 and 186 execute a website application program that retrieves application code from the back-end server 182 and executes the application code to render one or more webpages on a display device of a client computing device 168 in response to requests received from the user via the client computing device 168 to allow users to interact with the website. The website hosting servers 184 and 186 are configured to generate and display webpages displaying a game. For example, the real money gaming website hosting server 184 is configured to host a real money wagering website that enables players to convert monetary funds to gaming credits that may be used to place wagers on the game. The social gaming website hosting server 186 is configure to host a social media and/or social gaming website that allows players to receive gaming credits for activities such as purchasing goods and/or services through an e-commerce website, and/or purchase gaming credits that may be used to play the game.

Each back-end server 182 is configured to perform operations to support the functions of the webpages and/or website being displayed by the website hosting servers 184 and 186. For example, in one embodiment, the back-end servers 182 may include a player account system server that is configured to generate player accounts that include data associated with a player including, but not limited to, player identification information, player financial account information, player gaming credit account information, and/or any suitable player information, that may be used to establish credit meters and allow players to place wagers on the game.

Each remote gaming server 180 includes one or more copies of the game application program 92 stored in a memory device of the remote gaming server 180. A processor of the remote gaming server 180 is programmed to retrieve and transmit the game application program 92 to one or more back-end servers 182 for use in displaying the game to the user via a webpage being displayed by the web browser program.

In one embodiment, the game application program 92 may include instructions for rendering the game and executing the game on the client computing device 168. For example, the game application program 92 may include instructions for generating rendered code, such as, for example HTML code, that may be used by the web browser program of the client computing device 168 for displaying the game. For example, the game application program 92 may include program software code including, but not limited to, HTML, JavaScript, cascade style sheets (CSS), and any suitable programming code that may be used for rendering and operating the game via a website and/or mobile computer application.

In one embodiment, upon receiving a request from the website hosting servers 184, 186 via the back-end server 182, the remote gaming server 180 may execute the game application program 92 to operate the game, and execute a render-to-string operation to generate rendered code indicative of the game, such as, for example HTML code, and transmit the rendered code to the back-end server 182. The back-end server 182 may then transmit the rendered code to the corresponding website hosting servers 184, 186 for use in displaying the game on the website. As the player plays the game, the remote gaming server 180 may execute the game application program 92 for each instance of the game, and transit rendered code to the back-end servers 182.

In another embodiment, the remote gaming server 180 may transmit the game application program 92 to the back-end server 182 and/or the website hosting servers 184, 186. The back-end server 182 and/or the website hosting servers 184, 186 may then execute the game application program 92 to initiate the instances of the game and execute render-to-string operations to generate rendered code indicative of the game.

In yet another embodiment, the back-end server 182 may receive a request to initiate the game from a mobile computing device 174 executing the mobile computer application program. Upon receiving the request, the back-end server 182 may access the game application program 92 and execute a render-to-string operation to generate rendered code indicative of the game and transmit the rendered code to the mobile computing device 174. In one embodiment, the back-end server 182 may continuously execute the game application program 92 to generated each instance of the game using a random number generator of the back-end server 182 based on input received from the mobile computing device 174 and generate and transmit rendered code for each instance of the game to the mobile computing device 174. In another embodiment, the back-end server 182 may execute a partial-render operation and generate partially-rendered code of the game using the game application program 92, and transmit the partially rendered code of the game and object data of game assets to the mobile computing device 174. The partially rendered code includes instructions for generating rendered code using the game assets and a random number generator of the mobile computing device for generating and displaying the game on the mobile computing device 174 using the mobile computer application program.

In one embodiment, the game application program 92 may be stored on several different servers. The game code on these servers is used to distribute game content to social or real money gaming websites and mobile applications. The distribution method is very flexible. For example, the game code and/or game application program 92 including game code and game object assets may be stored on a remote gaming server 180. One remote gaming server 180 may be connected to one or more back-end server 182.

Each back-end server 182 is configured to distribute the games to one or more websites or mobile applications. Players connect to these websites/mobile applications with the client devices or mobile devices and have access to the game content. A copy of game application program 92 including game code and game object assets is stored on the remote gaming server 180 for each back-end server 182 that is connected to the remote gaming server 180 and that distributes the game. For example, if one remote gaming server 180 is connected to two back-end servers 182, which is connected to three website hosting servers 184, 186 that distribute the game, the remote gaming server 180 would store two copies of the game application program 92 including game code and game object assets for the game (e.g. one copy for each back-end server 182).

For example, the server system 170 may be configured to implement the game on a mobile application such as, for example, "my KONAMI Slots™" mobile application available in Apple iOS™, Google Android™, and Amazon Kindle™ operating platforms, or on social-media websites such as the "my KONAMI Slots™" available on Facebook™. In one embodiment, the mobile application may download the game code from remote gaming server 180 via the real money gaming site 184 or the social gaming site 186 and execute the game code on the client computing device 168. In this embodiment, the game code may provide game specific/front-end function when executed by the processor of the client computing device, and the back end system 182 may provide generic/back-end function.

FIGS. 13-18 are flow charts of methods 300, 400, 500, 600, 700, and 800 illustrating the algorithms included in the game application program 92 and performed by the processor 38 when executing the game application program 92 for operating the gaming machine 10 and/or iGaming server system 170 to implement the game. The methods include a plurality of steps. Each method step may be performed independently of, or in combination with, other method steps. Portions of the methods may be performed by any one of, or any combination of, the components of the gaming machine 10 and/or iGaming server system 170. FIGS. 19-26D are diagrammatic illustrations of a game being displayed on the display area of the gaming machine in FIGS. 1A-1B and the mobile computer device shown in FIG. 12, according to an embodiment of the present invention. FIGS. 27-36 are exemplary illustrations of computer program data files that may be used by processor 38 when executing the game application program 92.

In the illustrated embodiment, the game execution program 92 includes computer instructions for generating a primary game that includes a bonus feature selection game that includes a plurality of bonus features that may be used during the primary game. In general, the bonus feature game provides randomly selected bonus features that are used during the primary game. In addition, the bonus feature game provides an option to the player to sell one or more randomly selected bonus features in exchange for a credit value associated with the bonus feature, and awards the credit value to the player if the player elects to sell the selected bonus feature. In one embodiment, the primary game includes a reel-type game that includes a plurality of virtual reels that spin and stop to display the outcomes of the primary game. The bonus features included in the bonus feature game may include, for example, wild symbols, free spins, award multipliers, progressive multipliers, and/or any suitable feature that may be implemented with the primary game. In other embodiments, the primary game may include a playing card game, a bingo game, a Keno game, and/or any suitable casino type wagering game.

Figure 13:
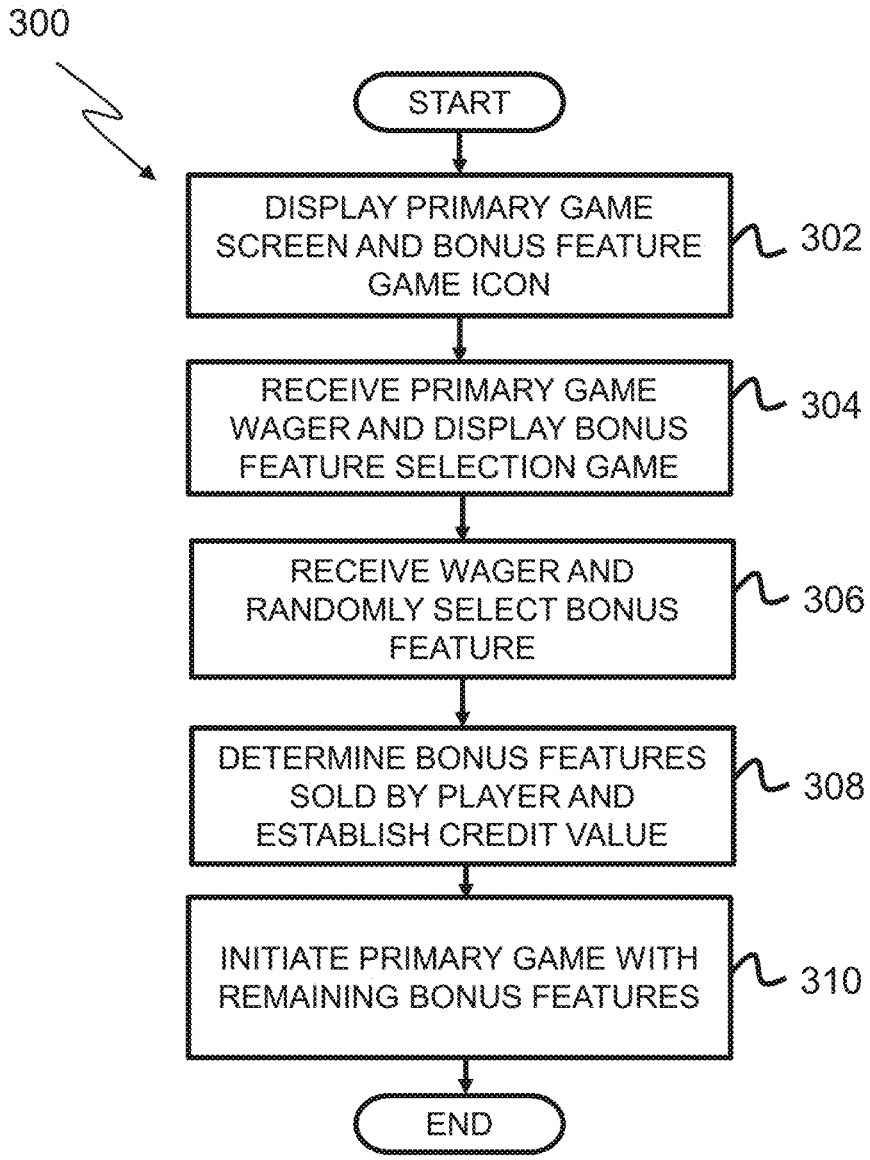
FIGS. 13-18 are flow charts illustrating the algorithms used during operation of the gaming machine during a game, according to one embodiment of the present invention.

Referring to FIG. 13, in the illustrated embodiment, in method step 302, the processor 38 displays a primary game screen 188 (shown in FIGS. 3 and 25A) in the display area 64 of the display unit 24. The primary game screen 188 is displayed with a bonus feature game icon 190 than notifies the player of a bonus feature selection game 200 (shown in FIGS. 19-25H) that may be implemented with the primary game 202. The bonus feature game icon may also appear in one of the buttons 34 positioned on the control panel 18. In the illustrated embodiment, the primary game 202 is displayed with the plurality of virtual reel strips 72 to 80 on the lower display 16.

In one embodiment, the player may transmit a request to implement the bonus feature selection game 200 may touching the bonus feature game icon 190 being displayed on a touchscreen of the display unit 24 and/or depressing a corresponding button 34 on the operation unit 32 that is displaying the bonus feature game icon 190. Upon receiving a signal from the display unit 24 and/or the operation unit 32, the processor 38 initiates the bonus feature game 200 and modifies the bonus feature game icon 190 to notify the player.

In method step 304, the processor 38 receives a signal from the operation unit 32 indicating a wager being placed on the primary game 202 by the player, and responsively initiates the bonus feature selection game 200 by displaying a bonus feature selection game screen 204 (shown in FIGS. 19-25H) on the display unit 24. The bonus feature selection game screen 204 includes a plurality of bonus feature images 206 that are associated with a plurality of bonus features 208 that may be used during the primary game 202.

In the illustrated embodiment, upon initiating the bonus feature game 200, the processor 38 generates a bonus feature data table 210 (shown in FIG. 35) including data records 212 associated with the plurality of bonus features 208. Each data record 212 is associated with a corresponding bonus feature 208 and includes a credit value 214, a feature counter 216 indicating a number of times the corresponding bonus feature 208 has been selected during the bonus feature game 200, and a total credit value 214. The total credit value 214 is determined as a product of the feature counter 216 and the credit value 214.

In one embodiment, the processor 38 generates the bonus feature data table 210 by accessing the bonus feature table 136 that includes the records associated with each bonus feature 208 including a selection probability 218, a credit value 214, and a return to player value 220. The return to player value 220 indicates an average rate of return provided to the player when the instance of the primary game 202 includes the corresponding bonus features.

In one embodiment, the processor 38 determines the credit value 214 associated with each bonus feature 208 by accessing a return-to-player data table 222 (shown in FIG. 34) that includes a bonus feature game data record 224 associated with the bonus feature selection game 200 and a primary game data record 226 associated with the primary game 202. The bonus feature game data record 224 includes a feature game bet value and a feature game return to player value associated with the bonus feature selection game 200 (e.g. the "Loot box feature"). The primary game data record 226 includes a primary game bet value and a primary game return to player value associated with the primary game 202. The processor 38 retrieves the bonus feature game record 224 and generates a bonus feature expected return data table 228 (shown in FIG. 30). The bonus feature expected return data table 228 includes a selection probability 218, an expected return to player value 230, and a feature return to player value 220 associated with each bonus feature 208. The processor 38 calculates the expected return to player value 230 associated with each bonus feature 208 based on the feature game return to player value included in the bonus feature game data record 224, and calculates the expected return to player value 230 of each bonus feature 208 as the quotient of the corresponding feature return to player value 220 divided by the corresponding selection probability 218. For example, in one embodiment, a "Wild" bonus feature 208 may include a selection probability 218 equal to 12.5% and a feature return to player value 220 equal to 31.25%. The processor 38 calculates the expected return to player value 230 of the "Wild" bonus feature 208 to be 250.00% (i.e. 0.3125/0.125=2.50, or 250.00%). The processor 38 then calculates the credit value 214 associated with the bonus feature 208 as the product of the expected return to player value 230 and the feature game bet value included in the bonus feature game data record 224. For example, as shown in FIG. 29, the processor 38 calculates the credit value 214 (e.g. Selling price) for the "Wild" bonus feature 208 to be 250 credits (i.e. 2.50×100 credits=250 credits). FIG. 29 further shows the credit value 214 for the "Multiplier" bonus feature 246 to be 500 credits, the credit value 214 for the "Free Spin" bonus feature 248 to be 150 credits and the credit value 214 for the "Lose" bonus feature 250 to be 5 credits. These credit values are calculated in the same manner as that of "Wild" bonus feature 208. In one embodiment, all or a part of the values and tables mentioned in this document might be predetermined and implemented as data files stored in the program data 96 folder stored in the memory 42 of the gaming machine 10 illustrated in FIG. 7.

In the illustrated embodiment, the bonus feature table 136 illustrated the probability of each bonus feature item in the box, the selling price of each bonus feature item 208 and, and the Return to Player when the player sells each bonus feature item 208. The player has an option to sell the bonus feature items 208 and an option to bring the bonus feature items 208 to a subsequent base game.

As shown in FIG. 30, bonus feature expected return data table 228, shows the probability of each bonus feature item 208 in the feature game 200, the Expected return to player of a subsequent base game when the player applies each bonus feature item 208, and the Return to Player of each bonus feature item 208 calculated by multiplication of probability and Expected return to player. The Expected return to player is a payout ratio of subsequent base game enhanced by each bonus feature item 208. The Return to Player shows contribution of each bonus feature item 208 to a total return to player of the Loot box Feature game 200. In addition, "Lose" item doesn't have an impact to base game. However, it is possible to add selling price of the "Lose" item to win amount of the subsequent base game when the player applies the "Lose" item to the subsequent base game. In addition, the bonus feature expected return data table 228 is compatible with bonus feature table 136 and shows the same Return to Player. The processor 38 may balance the selling price and expected return to player so as to provide the same Return to Player. By doing so, the processor 38 implements the same Return to Player regardless of whether the player sells the item or the player brings the item to the subsequent base game.

In addition, data table 232, shown in FIG. 36 illustrates the bet amount and Return to Player of base game 202 and Loot Box feature 200. The total Return to Player (RTP %) is derived from the following formula:

$$\text{Total } RTP\ \% = \frac{\text{Base game Bet} \times \text{Base game } \% + \text{Loot box Bet} \times \text{Loot box } \%}{\text{Base game Bet} + \text{Loot box Bet}}$$

Referring to FIG. 36, data table 232 includes the number of loot box challenged, Return to Player of base game, total bet of loot box bet and base game bet, and total Return to Player of loot box and base game. (e.g. Total Bet=Base game Bet+Loot box Bet).

Figure 21:
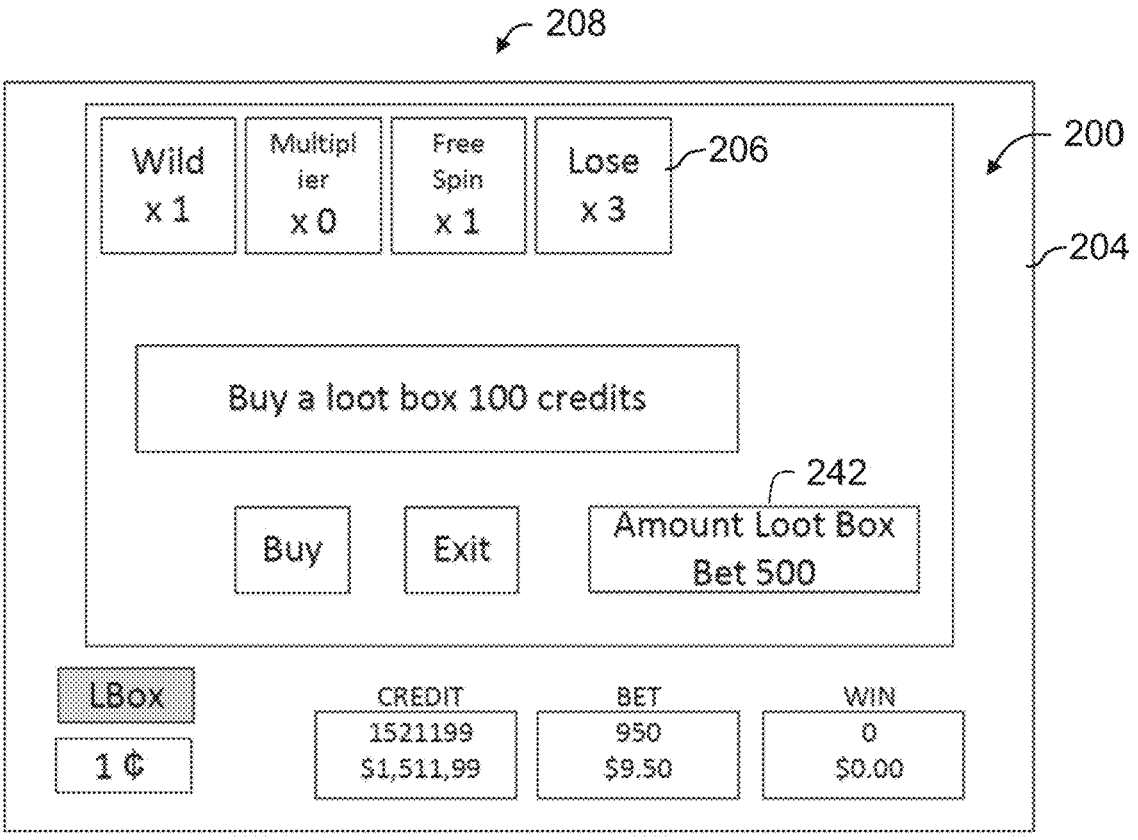
Figure 22:
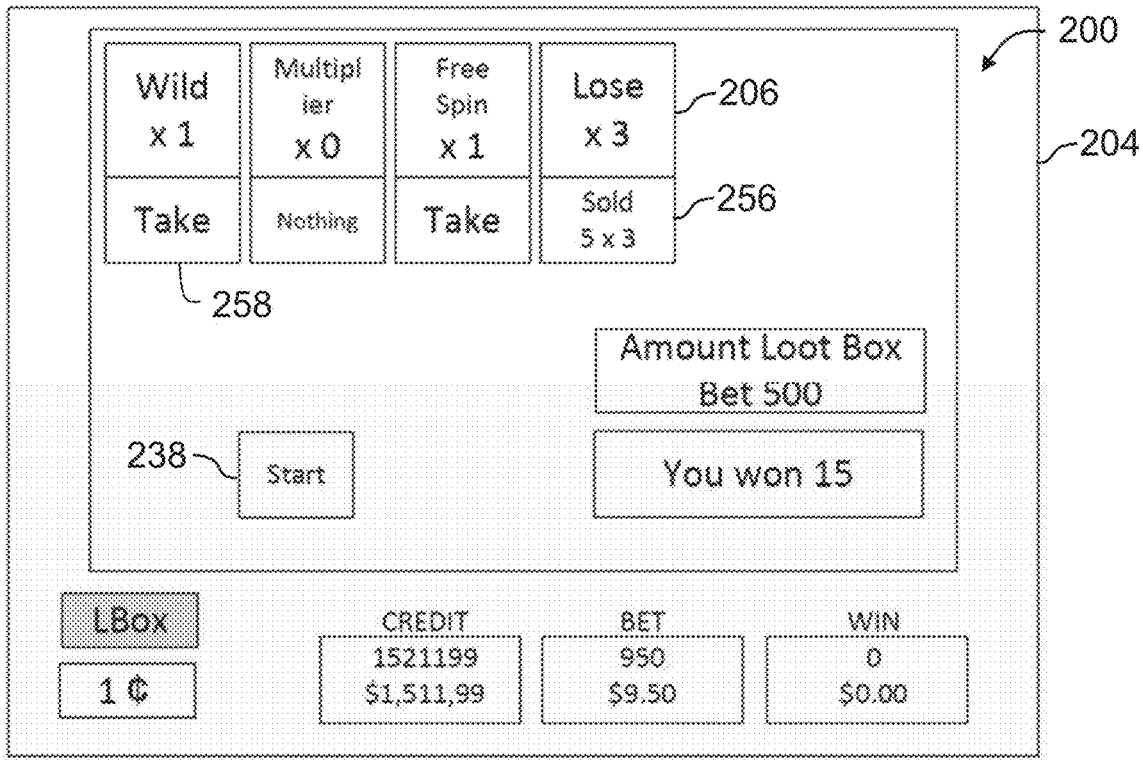

In method step 306, the processor 38 receives a signal from the operation unit 32 indicating a wager being placed on the bonus feature game 200 by the player. For example, in one embodiment, the processor 38 displays a bonus feature wager icon 234 (e.g. a "Buy" icon shown in FIG. 19) on the bonus feature selection game screen 204 to prompt the player to place a wager on the bonus feature selection game 200. In addition, the processor 38 displays an exit icon 236 (e.g. "Exit") that allows the player to terminate the bonus feature selection game 200, and a primary game start icon 238 (e.g. "Start") that allows the player to initiate an instance of the primary game 202. In response to receiving each signal indicating a wager being placed by the player, the processor 38 randomly selects a bonus feature 208 from the plurality of bonus features 208 and modifies the bonus feature image 206 (as shown in FIGS. 21 and 22) associated with the selected bonus feature 208 to indicate a number of times the corresponding bonus feature 208 has been randomly selected during the bonus feature selection game 200. In addition, in responsive to randomly selecting a bonus feature 208, the processor 38 modifies the bonus feature data table 210 to increment a corresponding feature counter 216 associated with the selected bonus feature 208.

For example, in one embodiment, upon receiving the wager, the processor 38 retrieves a random number from the random number generator, accesses the bonus feature table 136 and randomly selects one of the bonus features 208 based on the corresponding selection probability 218 and the retrieved random number. The processor 38 then displays a feature animation 240 (shown in FIG. 20) on the bonus feature selection game screen 204 to notify the player of the selected bonus feature 208. The processor 38 then modifies the bonus feature data table 210 to increment a corresponding feature counter 216 and modifies the bonus feature image 206 to increment the number of times the corresponding bonus feature 208 has been randomly selected. The processor 38 also displays a total amount bet 242 on the bonus feature selection game screen 204.

In the illustrated embodiment, the plurality of bonus features 208 includes a wild symbol bonus feature 244 (shown in FIGS. 19 and 26A-26D), a multiplier bonus feature 246, a free game feature 248, and a lose feature 250. The wild symbol feature 244 is associate with a feature that includes a wild symbol being randomly populated in a cell during the primary game 202. The multiplier bonus feature 246 is associated with a feature that multiplies an initial award provided in the primary game 202 by a multiplier value. The free game feature 248 is associated with a feature that awards a number of free games and/or free spins. The lose feature 250 is associated with a credit award provided during the bonus feature selection game 200 and does not provide any additional feature in the primary game 202.

In one embodiment, if the processor 38 randomly selects the multiplier bonus feature 246, the processor 38 may access the multiplier feature tables 140, and randomly select a multiplier value 252 and/or progressive probability value 254 from the multiplier feature tables 140. The processor 38 then modifies the bonus feature data table 210 to include the selected multiplier value 252 and corresponding credit value 214 included in the multiplier feature tables 140.

In method step 308, the processor 38 receives a signal from the operation unit 32 indicating a request to terminate the bonus feature selection game 200 by the player, and prompts the player to select one or more of the randomly selected bonus features 208 to exchange for credit value. For example, as shown in FIG. 22, the processor 38 may receive a player's selection of the exit icon 236 indicating a request to terminate the bonus feature selection game 200. In response to receiving the request, the processor 38 modifies the bonus feature images 206 to include a sell icon 256 (shown in FIG. 22) to request an exchange of the bonus feature 208 for credits and/or a take icon 258 to request the corresponding bonus features 208 be used during the primary game 202.

In the illustrated embodiment, the processor 38 receives a signal from the operation unit 32 indicating a request to sell a previously selected bonus feature 208 by the player, and responsive to receiving the signal indicating a request to sell a previously selected bonus feature, the processor 38 determines a credit value 214 of the previously selected bonus feature 208 associated with the request to sell, and adjusts the credit balance associated with the player based on the credit value of the previously selected bonus feature associated with the request to sell.

Figure 23:
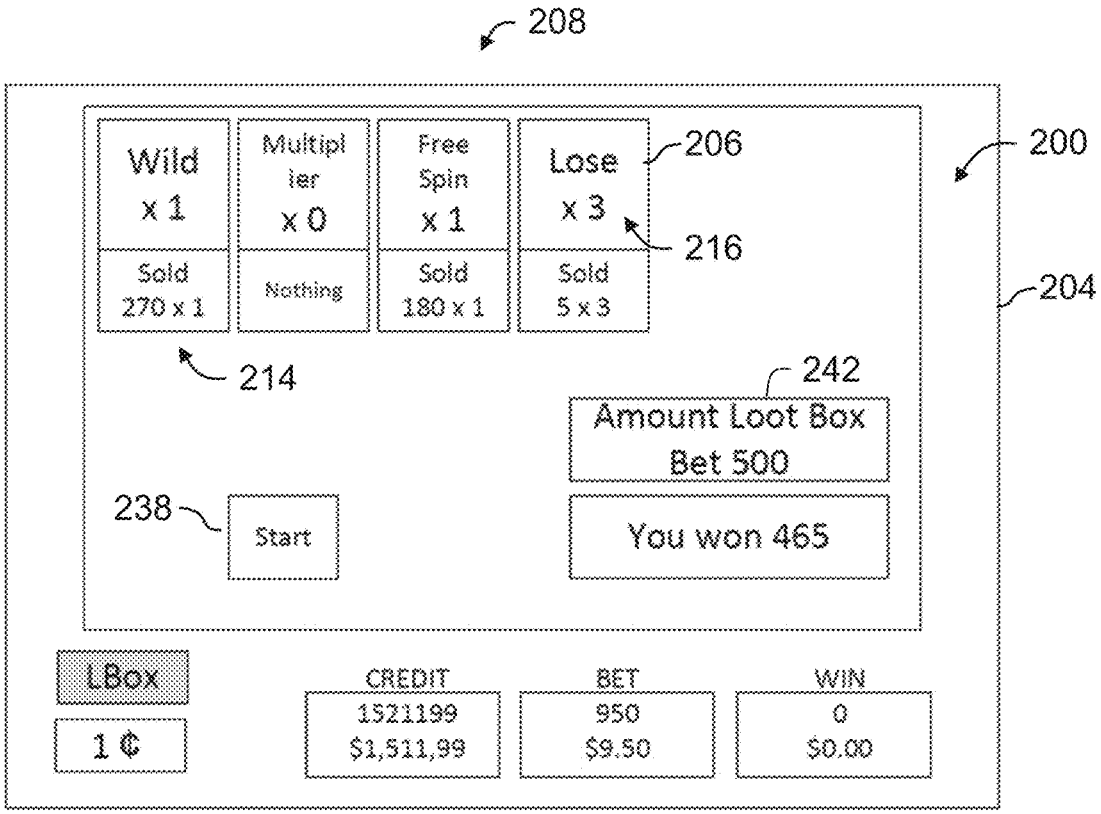
Figure 24:
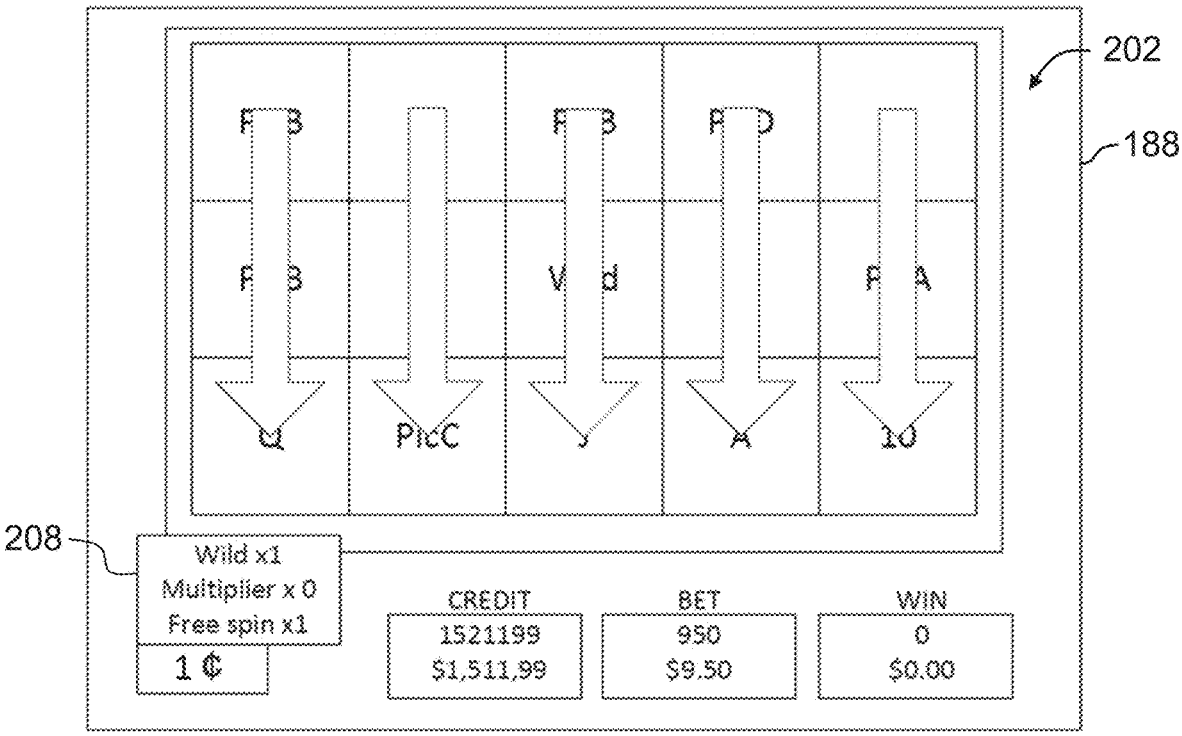
Figure 25A:
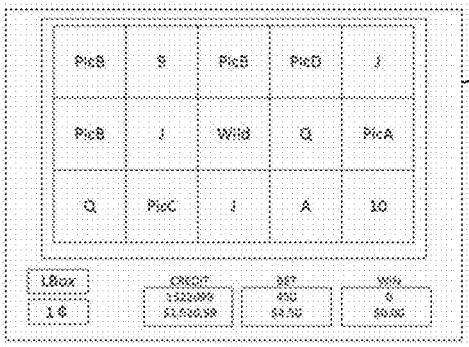
FIGS. 25A-25H are diagrammatic illustrations of a sequence of graphic images that may be used to display the game shown in FIGS. 19-24, according to an embodiment of the present invention.
Figure 25B:
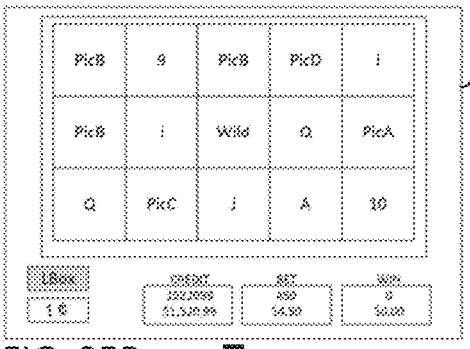
Figure 25C:
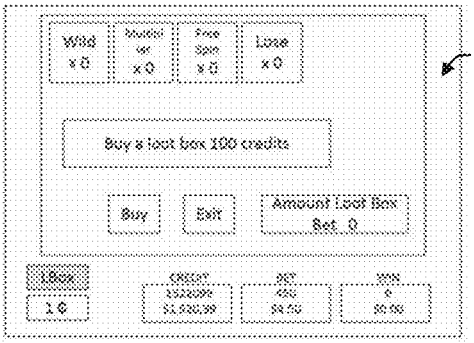
Figure 25D:
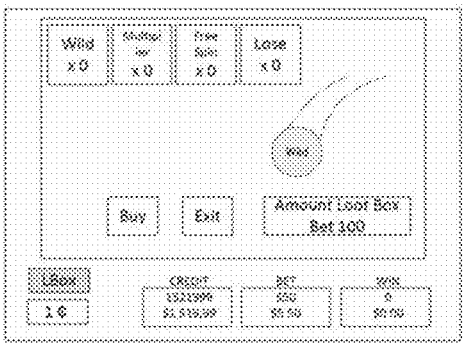
Figure 25E:
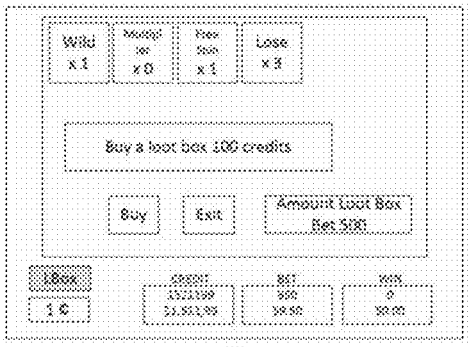
Figure 25F:
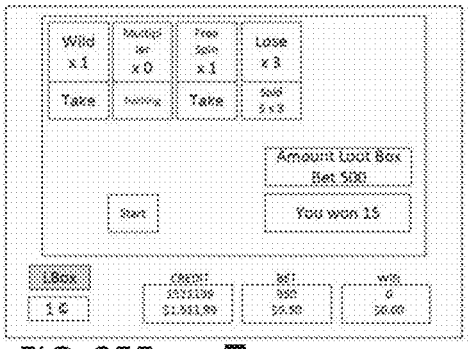
Figure 25G:
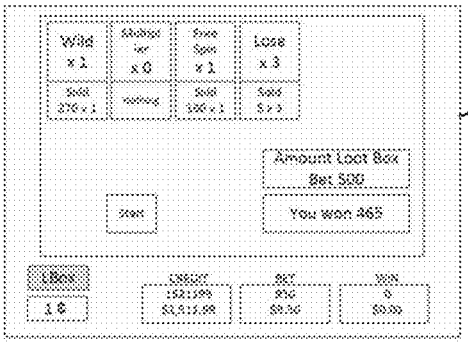
Figure 25H:
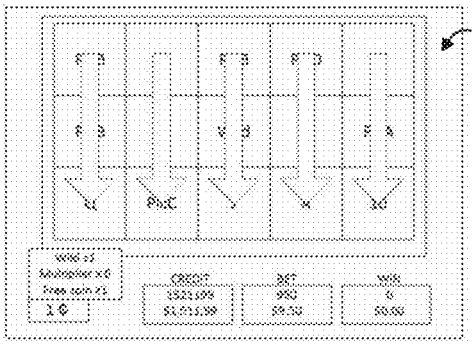
Figure 26A:
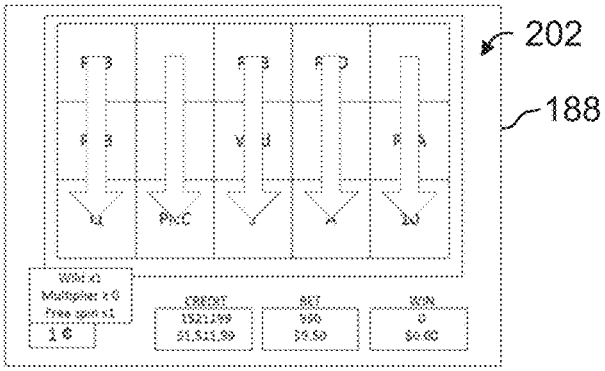
FIGS. 26A-26D are diagrammatic illustrations of a sequence of graphic images that may be used to display the game shown in FIGS. 19-24, according to an embodiment of the present invention.
Figure 26B:
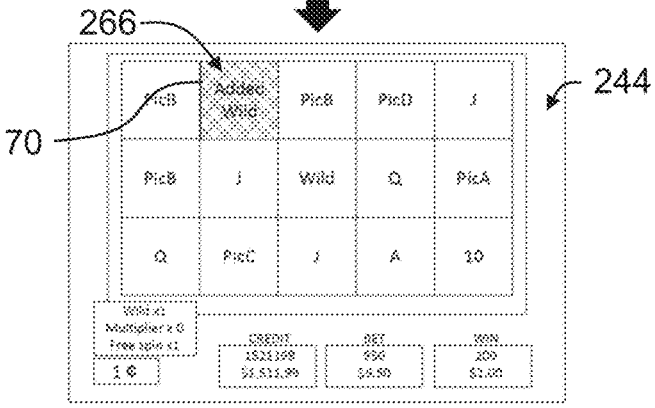
Figure 26C:
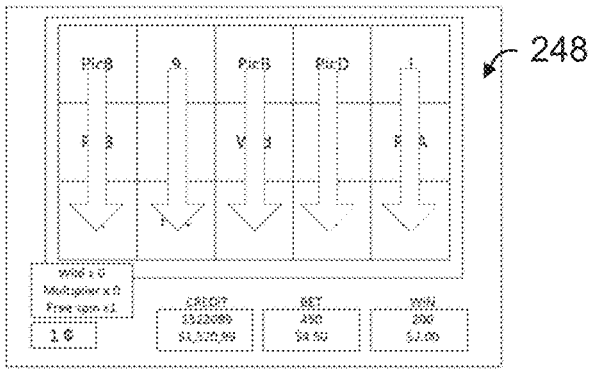
Figure 26D:
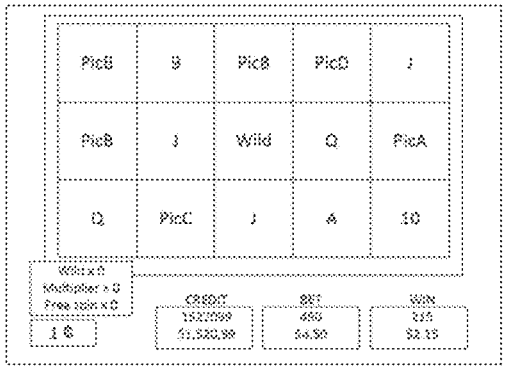

For example, as shown in FIG. 23, upon receiving a request to terminate the bonus feature game 200, the processor 38 modifies the bonus feature icons 206 to displays a number of each bonus feature 208 that has been selected during the bonus feature selection game 200, based on the feature counter 216 included in the bonus feature data table 210. The processor 38 may also display a credit value 214 associated with each bonus feature 208. The processor 38 may then receive a signal indicating a player's selection of a sell icon 256 associated a previously selected bonus feature 208 and responsively determine a credit value 214 associated with the player selected bonus feature 208, and add the credit value to the credit meter. The processor 38 modify the bonus feature data table 210 to decrease a corresponding feature counter 216 associated with the previously selected bonus feature 208, in response to receiving the signal indicating the request to sell a previously selected bonus feature 208.

In method step 310, the processor 38 receives a signal from the operation unit 32 indicating a player's selection of the primary game start icon 238, and initiates an instance of the primary game 202 using the selected bonus features 208. For example, upon receiving a signal from the player to initiate an instance of the primary game 202, the processor 38 retrieves the modified bonus feature data table 210, and initiates the primary game 202 using the modified bonus feature data table 210. The processor 38 uses the feature counters 216 to determine a number of times each of the bonus features 208 are used during the primary game 202.

During the primary game 202, the processor 38 initiate an instance of the primary game using the selected bonus features and provide a primary game award to the player based on an outcome of the instance of the primary game 202 and adjust a credit balance associated with the player based on the primary game award. In one embodiment, the processor 38 may be programmed to adjust the credit balance associated with the player based on the credit value of the previously selected bonus feature after providing the primary game award to the player.

Figure 14:
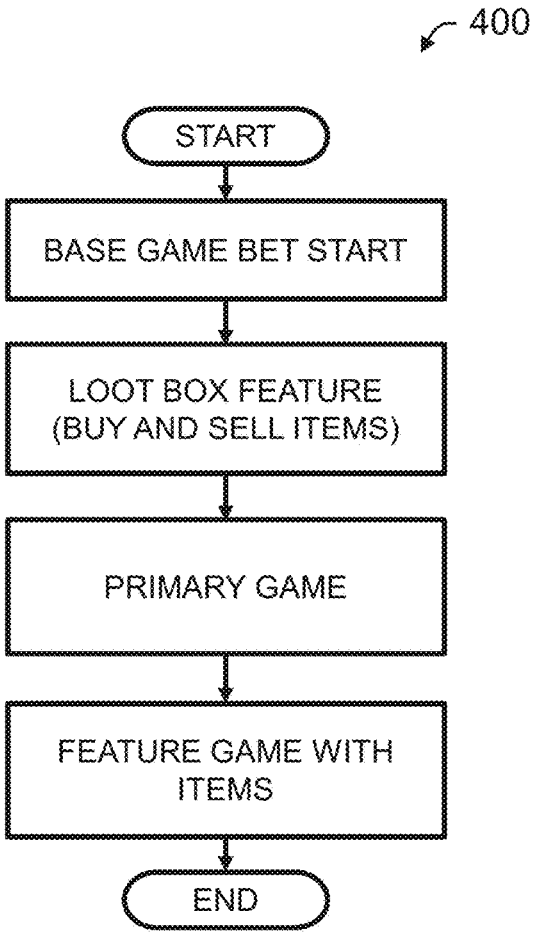
Figure 15:
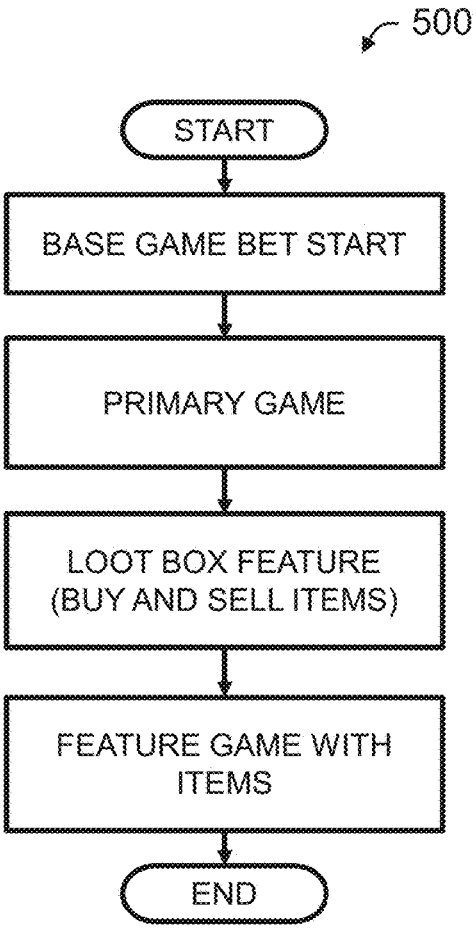

With reference to FIGS. 14 and 15, in one embodiment, the processor 38 may implement method 400 to execute the bonus feature selection game 200 prior to initiating the primary game 202 and use the selected bonus features 208 during the primary game 202. In another embodiment, the processor 38 may implement method 500 to execute the bonus feature selection game 200 upon detecting a trigger condition occurring during the primary game 202, and use the selected bonus features 208 during a subsequent feature game.

Figure 16:
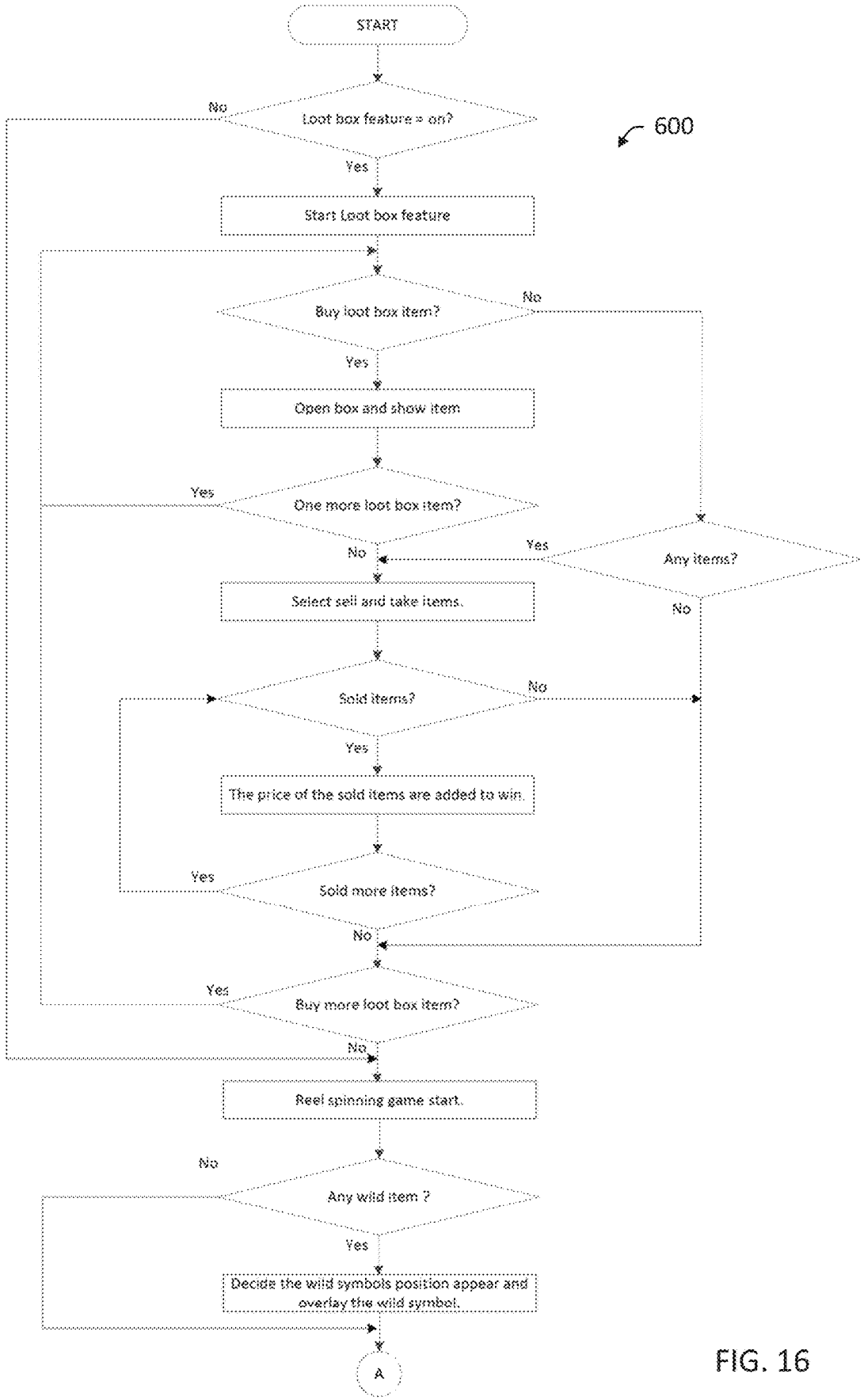
Figure 17:
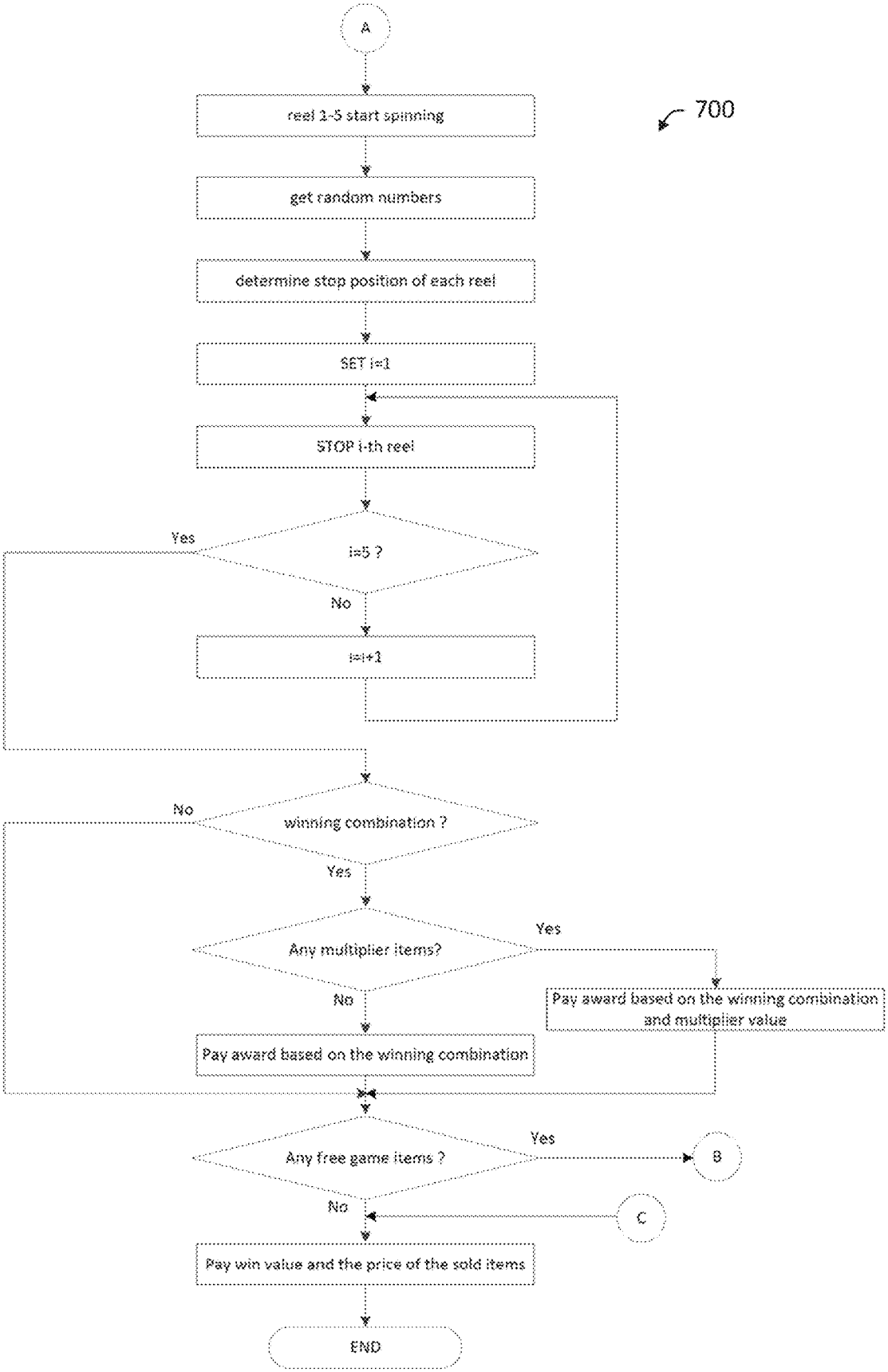
Figure 18:
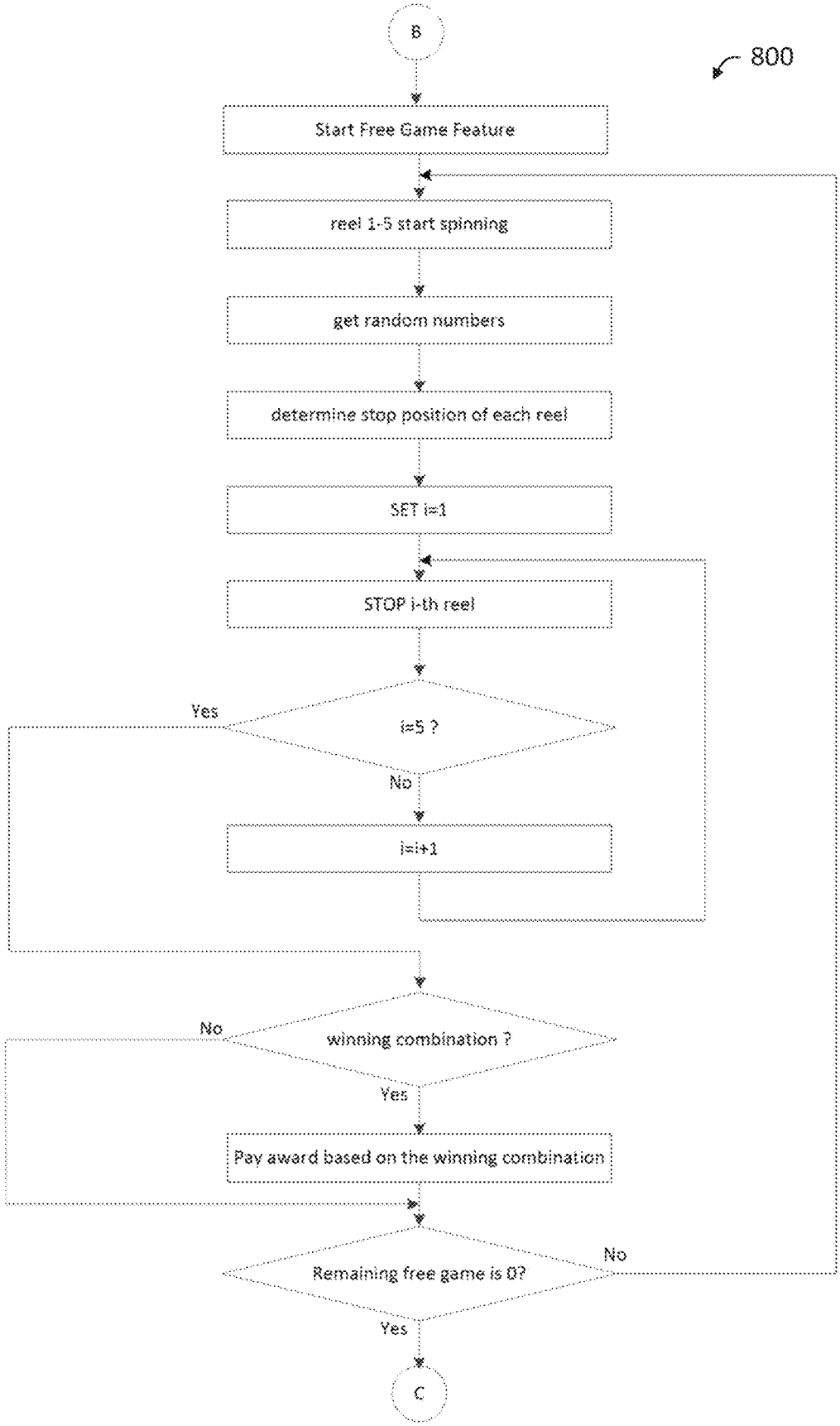
Figure 19:
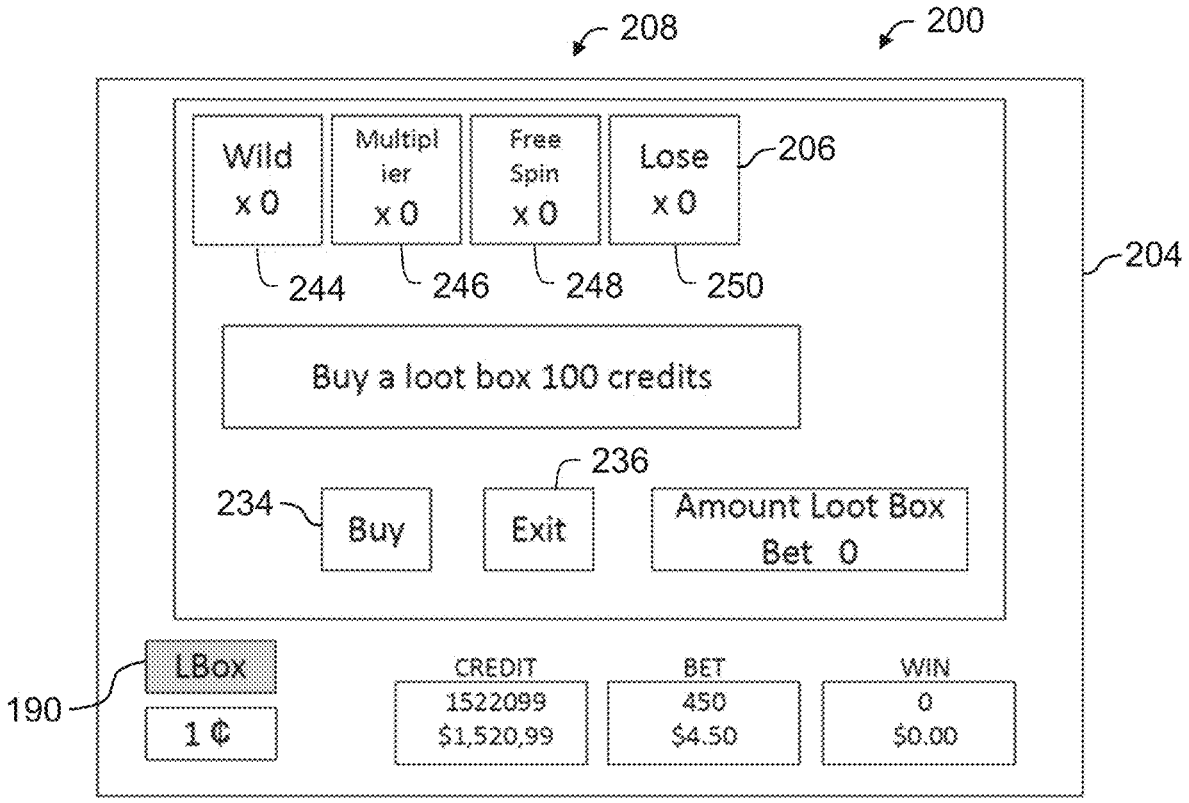
FIGS. 19-24 are diagrammatic illustrations of a game being displayed on the display area of the gaming machine in FIGS. 1A-1B and the mobile computer device shown in FIG. 12, according to an embodiment of the present invention.
Figure 20:
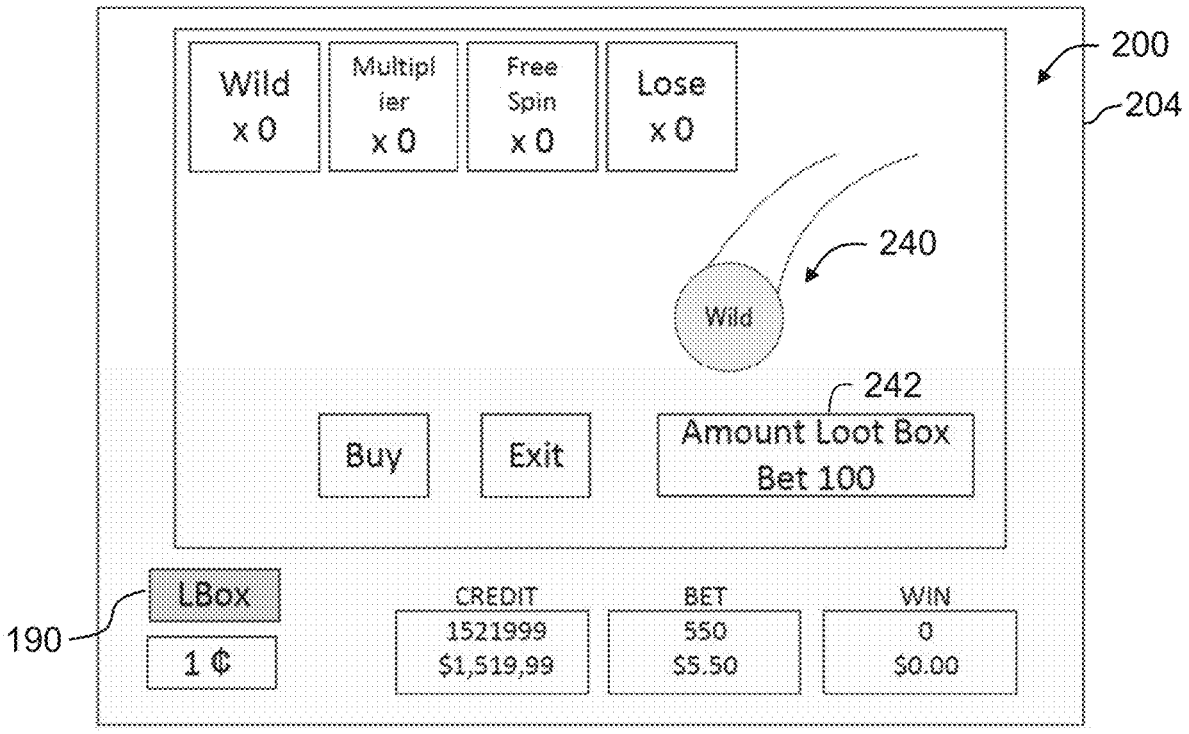

Referring to FIGS. 16-18, in one embodiment, the processor 38 may implement methods 600, 700, and 800 to execute the bonus feature selection game 200. Prior to initiating an instance of the primary game 202, the processor 38 determines whether the player has selected bonus feature selection game icon 190 (e.g. "LBox" icon). For example, if a player pushes the "LBox" button before game start, the Loot box feature 200 is provided by the processor 38. ("LBox" button is toggle button). The processor 38 then displays the loot box feature screen 204 after the player presses the start button. The processor 38 then determines whether the player requests to buy a bonus feature 208. For example, if the player pushes "Buy" button, the processor 38 randomly selects a bonus feature item 208 and an object appears to display the award. (e.g. Wild, Multiplayer, Free Spin or Lose). The processor 38 then allows the player can try to buy multiple bonus feature items 208. The processor 38 also allows the player to sell the selected items for credit values 214. After the player selects "Exit", the player can sell the redundant items (as shown in FIG. 23, one of "Lose" item is sold at 5 credits). The player may also sell additional bonus features 208 if available (e.g. "Wild", "Multiplier" and "Free Spin" are sold at the predetermined value.) Upon detecting a request to sell a previously selected bonus feature 208, the processor 38 determines the credit value associated with the player selected item and adds the credit value to the credit meter associated with the player. After pushing "Start" button, the processor 38 initiates the primary game 202 and the reels start spinning.

In the illustrated embodiment, the processor 38 initiates an instance of the primary game 202 using the bonus features 208 that have been awarded during the bonus feature selection game 200 and have not been exchanged and/or sold by the player. In one embodiment, during the primary game 202, the processor 38 randomly determines an outcome of an instance of the primary game 202 and spins the virtual reel strips 72 to 80 (as shown in FIGS. 26A-26D) and sequentially stops the virtual reel strips 72 to 80 to display the randomly generated outcome including a game symbol being displayed in each cell 70 of the grid 68. For example, in one embodiment, the processor 38 may execute the algorithm 600, 700, and 800 shown in FIGS. 16-18, including receiving a signal indicating the player depressing the spin button and start spinning each virtual reel strip 72 to 80, obtain random numbers from the random number generator, and determine a stop position of each virtual reel strip 72 to 80 based on the random numbers and the stop position data file 28. In one embodiment, the processor may obtain a random number for each simulate virtual reel strip 72 to 80, i.e. five random numbers. The processor 38 then established a reel stop counter, "i", and sets the reel stop counter, i, equal to x. The processor 38 then identifies the $i^{th}$ virtual reel strip associated with the stop counter, i, and stops the identified virtual reel strip to display the corresponding symbols in the corresponding cells 70 associated with the identified virtual reel strip. The processor then increments the reel stop counter, i, by x, i.e. i=i+x, and repeats the process of identifying the virtual reel strip associated with the incremented reel stop counter and stopping the identified virtual reel strip. This process continues until each virtual reel strip has been stopped. In this embodiment, for example, the virtual reel strips are numbered 1-5. In one embodiment, during the reel spin, the player may initiate the stopping of the reels by depressing the spin button, which enables the player to accelerate game play.

In one embodiment, upon receiving a signal indicating the player depressing the spin button, the processor may generate each virtual reel strip 72 to 80 for use during the instance of the primary game 202. For example, in one embodiment, the processor 38 may execute the game application program 92 using the reel layout table 132 for use in generating each virtual reels 72 to 80. The processor 38 may accesses the reel layout table 132 and identify a reel designation 260 and stop position 262 associated with the virtual reel being generated, and access each sequential symbol position logic cell 264 for generating and displaying the corresponding game symbols. The processor 38 then generates the corresponding virtual reel strip based on the instructions associated with each sequential symbol position logic cell 264, associated with the reel designation 260. In addition, the processor 38 accesses the inner symbol table 138 to randomly select a symbol that is populated in symbol position designating a varying symbol ("inn"). Each "inn" logic cell is transformed into PicA, PicB, PicC, PicD, A, K, Q, J, 10 or 9 in each game, such that each "inn" logic cell is populated with the same symbol.

Upon stopping the virtual reel strips 72 to 80, the processor 38 determines if any winning combination of symbols is displayed in the outcome if the instance of the primary game 202, and determines an initial award associated with the winning outcome. In one embodiment, the processor 38 detects an appearance of a winning combination of game symbols in the outcome based on the paylines shown in FIG. 6, and provides an initial award based on the winning combination of symbols and a paytable.

In the illustrated embodiment, upon stopping the virtual reel strips 72 to 80 to display the outcome of the instance of the primary game 202, the processor 38 accesses the bonus feature data table 210 to determine whether to initiate one or more bonus features 208. The processor 38 also determines a number of times to execute a corresponding bonus feature 208 based on the feature counter 216 included in the bonus feature data table 210.

For example, if the bonus feature data table 210 includes a feature counter 216 value associated with the wild symbol bonus feature 244, the processor is programmed to initiate the instance of primary game 202 using the wild symbol bonus feature by randomly selecting a stop position for each of the plurality of virtual reels 72 to 80, spinning and stopping each of the plurality of virtual reels 72 to 80 based on a corresponding randomly selected stop position. The processor 38 then randomly selects a cell 70 from the plurality of cells, populates the selected cell 70 with a wild symbol 266 (shown in FIG. 26B). The processor 38 randomly selects a number of cells 70 equal to the value of the feature counter 216. For example, if the feature counter 216 includes a value equal to three, the processor 38 randomly selects three cells 70, and populates each selected cell 70 with a wild symbol 266. The processor 38 then evaluates the outcome of the instance of the primary game 202 including the wild symbol 266. The processor 38 then provides the primary game award based on the outcome of the primary game 202 including the wild symbol 266.

In another embodiment, if the bonus feature data table 210 includes a feature counter 216 value associated with the multiplier bonus feature 246, the processor is programmed to initiate the instance of primary game using the multiplier bonus feature by randomly selecting a stop position for each of the plurality of virtual reels 66, spinning and stopping each of the plurality of virtual reels 66 based on a corresponding randomly selected stop position, and determining an initial award value based on the symbols being displayed with the virtual reels stopped. The processor 38 then determines a multiplier value 252 associated with the multiplier bonus feature 246 based on the multiplier value table 140, and determines a primary game award by multiplying the initial award value by the multiplier value 252. In one embodiment, if the bonus feature data table 210 includes a feature counter 216 value associated with the wild symbol feature 244 and the multiplier bonus feature 246, the processor 38 will execute the wild symbol feature 244 to populate the selected cells 70 with the wild symbols 166, determine the initial award value with the wild symbols and multiply the initial award by the multiplier value 252. In one embodiment, the processor 38 is programmed to implement the multiplier bonus feature 246 once during each instance of the primary game 202. For example, if the feature counter 216 associated with the multiplier bonus feature 246 includes a value equal to four, the processor 38 implements in multiplier bonus feature 246 in four sequential instances of the primary game 202.

In one embodiment, if the bonus feature data table 210 includes a feature counter 216 value associated with the free game feature 248, the processor is programmed to an instance of primary game using the free game feature by randomly generating an outcome of the primary game, spinning and stopping each of the plurality of virtual reels based on the randomly generated outcome, and providing the primary award based on the randomly generated outcome, then determining a number of free games associated with the free game feature 248. For each of the number of free games, the processor 38 randomly generates an outcome of a corresponding free game, and spins and stops each of the plurality of virtual reels to display the randomly generated outcome of the corresponding free game, and provide an award based on the randomly generated outcome of the corresponding free game. In one embodiment, the processor 38 may initiate the free game feature 248 after the wild symbol feature 244 and multiplier bonus feature 246 have been completed.

In such an embodiment, a gaming machine 10 providing a game in the form of a slot machine is described, but this is not limited thereto, and a game in the state of poker, a video card game called black jack, bingo, keno, a wheel game and the like may be provided. Further, it is possible to apply the present invention to a pachinko machine or a pachinko slot machine.

In the embodiment, determining the stop position of each reel is described as consecutively acquiring a random number that is used respectively, but the acquisition procedure of the random number is not limited to this. For example, when the game starts, the control unit 22 acquires these random numbers in a batch, and each random number may be stored in the storage area of the non-erasing memory 42 or the storage 44 when power failure occurs. In this type of situation, even when a power failure and the like occurs during a game, because the control unit 22 acquired the random number from the memory 42 or the storage 44 when the game started before the power failure occurred, when resuming the game after recovering from a power failure, the progress of the game can be reproduced. For example, when a game result obtaining a high payout is formed right before a power failure occurs, the player will be greatly dissatisfied if the progress of the game is not similar after recovering from a power failure. However, as mentioned above when the game starts all of the random numbers are acquired in a batch, and by saving these random numbers in the memory 42 or the storage 44, such great dissatisfaction can be avoided for the player because the progress of a game similar to before a power failure occurred can be reproduced after recovering from a power failure.

In another embodiment, the player may initiate a game through actuation of a spin button (or other button). After initiation of the game, the control unit 22 randomly determines the step position of all reels. The control unit 22 may perform the check for the trigger condition before the reels stop spinning, and thus has already determined the outcome of the game. However, the control unit 22 displays the outcome of the game in a step by step process as discussed above.

Further, in the embodiment, a bill/ticket is displayed as game value, and received by these bill/ticket identification devices, and a form where a ticket is output by a printer device 30 is described, but the present invention is not limited to this. The game value is a concept including tangible objects such as a coin, bill, medal, ticket, and the like, or electronic data that has a value equivalent to these. For example, a coin is received by the coin accepter, and there may be a form where a coin is paid by a coin hopper. A player is identified and credit that is accumulated in an account on a server is used, there may be a form where credit is paid to an account, information of credit stored in a storage medium of a magnetic card, IC card and the like is read and used, and there may be a form where credit is paid by writing to the storage medium.

Further, in the embodiment when showing a free game provided as a bonus game, a bonus game that uses a different virtual reel strips from a regular game may be provided. Further, there could be a provided a feature game according to a value of the random number acquired during a regular game.

Further, set conditions providing a bonus or feature game are not limited to trigger determination or line determination, for example there may be a configuration providing a bonus game when the bet number surpasses a predetermined value. There could be a configuration providing a bonus game according to a value of the random number acquired during a regular game.

Exemplary embodiments of a gaming device, a gaming system, and a method of providing an award to a player are described above in detail. The gaming device, system, and method are not limited to the specific embodiments described herein, but rather, components of the gaming device and/or system and/or steps of the method may be utilized independently and separately from other components and/or steps described herein. For example, the gaming device may also be used in combination with other gaming systems and methods, and is not limited to practice with only the gaming device as described herein. Rather, an exemplary embodiment can be implemented and utilized in connection with many other gaming system applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A gaming machine, comprising:

a cabinet;

a display device mounted to the cabinet; and a control unit operably coupled to the display device, the control unit including a processor programmed to execute an algorithm including the steps of:

displaying a primary game on the display device including a plurality of virtual reels;

spinning and stopping the virtual reels to display a first instance of the primary game; and initiating a loot box feature game upon detecting a trigger condition occurring in the first instance of the primary game by:

displaying a bonus feature selection game screen including a plurality of bonus features and a loot box buy icon;

detecting a player's selection of the loot box buy icon and responsively deducting a first credit amount from a credit meter, determining a corresponding selection probability for each of the plurality of bonus features, randomly selecting a first bonus feature from the plurality of bonus features based on the corresponding selection probabilities, and displaying the randomly selected first bonus feature on the bonus feature selection game screen;

detecting a player's selection of the randomly selected first bonus feature indicating a request to sell the randomly selected first bonus feature and responsively determining a second credit amount associated with the randomly selected first bonus feature and adding the second credit amount to the credit meter;

detecting a player's selection of a second bonus feature displayed on the bonus feature selection game screen; and detecting a player's selection of a game start icon indicating a request to initiate a second instance of the primary game using the player selected second bonus feature and responsively terminating the loot box feature game and initiating the second instance of the primary game using the player selected second bonus feature.

2. The gaming machine of claim 1, wherein the processor is programmed to execute the algorithm including the steps of:

determining the second credit amount associated with the randomly selected first bonus feature based on an expected return to player (RTP) value and the first credit amount.

3. The gaming machine of claim 2, wherein the processor is programmed to execute the algorithm including the steps of:

determining the expected RTP value based on a feature RTP value associated with the randomly selected first bonus feature and a corresponding selection probability.

4. The gaming machine of claim 1 wherein the processor is programmed to execute the algorithm including the steps of:

determining the plurality of bonus features to include a wild symbol bonus feature and a multiplier bonus feature.

5. The gaming machine of claim 1 wherein the processor is programmed to execute the algorithm including the steps of:

displaying the randomly selected first bonus feature including a counter indicating a number of times the randomly selected first bonus feature has been selected during the loot box feature game.

6. The gaming machine of claim 1 wherein the processor is programmed to execute the algorithm including the steps of:

detecting a subsequent player's selection of the loot box buy icon and responsively deducting another first credit amount from the credit meter, randomly selecting a another bonus feature from the plurality of bonus features, and displaying the randomly selected another bonus feature on the bonus feature selection game screen.

7. A method of operating a gaming machine including a display device mounted to a cabinet and a processor operably coupled to the display device, the method including the processor performing an algorithm including the steps of:

displaying a primary game on the display device including a plurality of virtual reels;

spinning and stopping the virtual reels to display a first instance of the primary game; and initiating a loot box feature game upon detecting a trigger condition occurring in the first instance of the primary game by:

displaying a bonus feature selection game screen including a plurality of bonus features and a loot box buy icon;

detecting a player's selection of the loot box buy icon and responsively deducting a first credit amount from a credit meter, determining a corresponding selection probability for each of the plurality of bonus features, randomly selecting a first bonus feature from the plurality of bonus features based on the corresponding selection probabilities, and displaying the randomly selected first bonus feature on the bonus feature selection game screen;

detecting a player's selection of the randomly selected first bonus feature indicating a request to sell the randomly selected first bonus feature and responsively determining a second credit amount associated with the randomly selected first bonus feature and adding the second credit amount to the credit meter;

detecting a player's selection of a second bonus feature displayed on the bonus feature selection game screen; and detecting a player's selection of a game start icon indicating a request to initiate a second instance of the primary game using the player selected second bonus feature and responsively terminating the loot box feature game and initiating the second instance of the primary game using the player selected second bonus feature.

8. The method of claim 7, including the processor performing the algorithm including the steps of:

determining the second credit amount associated with the randomly selected first bonus feature based on an expected return to player (RTP) value and the first credit amount.

9. The method of claim 8, including the processor performing the algorithm including the steps of:

determining the expected RTP value based on a feature RTP value associated with the randomly selected first bonus feature and a corresponding selection probability.

10. The method of claim 7, including the processor performing the algorithm including the steps of:

determining the plurality of bonus features to include a wild symbol bonus feature and a multiplier bonus feature.

11. The method of claim 7, including the processor performing the algorithm including the steps of:

displaying the randomly selected first bonus feature including a counter indicating a number of times the randomly selected first bonus feature has been selected during the loot box feature game.

12. The method of claim 7, including the processor performing the algorithm including the steps of:

detecting a subsequent player's selection of the loot box buy icon and responsively deducting another first credit amount from the credit meter, randomly selecting a another bonus feature from the plurality of bonus features, and displaying the another bonus feature on the bonus feature selection game screen.

13. A non-transitory computer-readable storage media having computer-executable instructions embodied thereon to operate a gaming machine including a display device mounted to a cabinet and a processor operably coupled to the display device, when executed by the processor the computer-executable instructions cause the processor to perform an algorithm including the steps of:

displaying a primary game on the display device including a plurality of virtual reels;

spinning and stopping the virtual reels to display a first instance of the primary game; and initiating a loot box feature game upon detecting a trigger condition occurring in the first instance of the primary game by:

displaying a bonus feature selection game screen including a plurality of bonus features and a loot box buy icon;

detecting a player's selection of the loot box buy icon and responsively deducting a first credit amount from a credit meter, determining a corresponding selection probability for each of the plurality of bonus features, randomly selecting a first bonus feature from the plurality of bonus features based on the corresponding selection probabilities, and displaying the randomly selected first bonus feature on the bonus feature selection game screen;

detecting a player's selection of the randomly selected first bonus feature indicating a request to sell the randomly selected first bonus feature and responsively determining a second credit amount associated with the randomly selected first bonus feature and adding the second credit amount to the credit meter;

detecting a player's selection of a second bonus feature displayed on the bonus feature selection game screen; and detecting a player's selection of a game start icon indicating a request to initiate a second instance of the primary game using the player selected second bonus feature and responsively terminating the loot box feature game and initiating the second instance of the primary game using the player selected second bonus feature.

14. The non-transitory computer-readable storage media of claim 13, wherein the computer-executable instructions cause the processor to perform the algorithm including the steps of:

determining the second credit amount associated with the randomly selected first bonus feature based on an expected return to player (RTP) value and the first credit amount.

15. The non-transitory computer-readable storage media of claim 14, wherein the computer-executable instructions cause the processor to perform the algorithm including the steps of:

determining the expected RTP value based on a feature RTP value associated with the randomly selected first bonus feature and a corresponding selection probability.

16. The non-transitory computer-readable storage media of claim 13, wherein the computer-executable instructions cause the processor to perform the algorithm including the steps of:

determining the plurality of bonus features to include a wild symbol bonus feature and a multiplier bonus feature.

17. The non-transitory computer-readable storage media of claim 13, wherein the computer-executable instructions cause the processor to perform the algorithm including the steps of:

displaying the randomly selected first bonus feature including a counter indicating a number of times the randomly selected first bonus feature has been selected during the loot box feature game.

* * * * *